US008511793B2

(12) United States Patent
Yokota et al.

(10) Patent No.: US 8,511,793 B2
(45) Date of Patent: Aug. 20, 2013

(54) EJECTION SURFACE CLEANING APPARATUS, LIQUID EJECTION APPARATUS AND EJECTION SURFACE CLEANING METHOD

(75) Inventors: Yasuyo Yokota, Ashigarakami-gun (JP); Noriaki Maida, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 648 days.

(21) Appl. No.: 12/722,485

(22) Filed: Mar. 11, 2010

(65) Prior Publication Data

US 2010/0231634 A1 Sep. 16, 2010

(30) Foreign Application Priority Data

Mar. 13, 2009 (JP) ..... 2009-061679

(51) Int. Cl.
*B41J 2/165* (2006.01)
*B41J 2/015* (2006.01)

(52) U.S. Cl.
USPC ..... 347/33; 347/21; 347/22

(58) Field of Classification Search
None
See application file for complete search history.

(56) References Cited

U.S. PATENT DOCUMENTS

| | | | | |
|---|---|---|---|---|
| 4,340,897 | A * | 7/1982 | Miller | 347/33 |
| 5,555,461 | A * | 9/1996 | Ackerman | 347/33 |
| 5,565,898 | A * | 10/1996 | Sakuma | 347/23 |
| 5,574,485 | A * | 11/1996 | Anderson et al. | 347/27 |
| 5,686,943 | A * | 11/1997 | Kneezel et al. | 347/17 |
| 5,790,147 | A * | 8/1998 | Hensel | 347/28 |
| 5,942,043 | A * | 8/1999 | Suemune | 134/18 |
| 5,963,229 | A * | 10/1999 | Fukuoka | 347/33 |
| 6,024,432 | A * | 2/2000 | Aruga et al. | 347/23 |
| 6,367,905 | B1 * | 4/2002 | Sharma et al. | 347/33 |
| 6,460,967 | B1 * | 10/2002 | Makita et al. | 347/33 |
| 6,513,910 | B2 * | 2/2003 | Naniwa et al. | 347/55 |
| 6,530,642 | B1 * | 3/2003 | Uchikata et al. | 347/33 |
| 6,823,877 | B2 * | 11/2004 | Kimura | 134/56 R |
| 6,863,366 | B2 * | 3/2005 | Premnath et al. | 347/22 |
| 6,935,720 | B2 * | 8/2005 | Takahashi | 347/29 |
| 8,303,078 | B2 * | 11/2012 | Inoue | 347/33 |
| 8,322,815 | B2 * | 12/2012 | Tsukada | 347/23 |
| 2001/0007459 | A1 * | 7/2001 | Midorikawa | 347/33 |
| 2003/0081047 | A1 * | 5/2003 | Yearout | 347/28 |
| 2004/0218002 | A1 * | 11/2004 | Nakamura | 347/33 |

(Continued)

FOREIGN PATENT DOCUMENTS

| | | |
|---|---|---|
| JP | 2001-054949 A | 2/2001 |
| JP | 2005-144737 A | 6/2005 |
| JP | 2007-331166 A | 12/2007 |
| JP | 2008-254200 | 10/2008 |
| JP | 2009-101630 | 5/2009 |

OTHER PUBLICATIONS

Office action dated Nov. 6, 2012 issued in Japanese application No. 2009-061679, 4 pgs.

*Primary Examiner* — Stephen Meier
*Assistant Examiner* — Leonard S Liang
(74) *Attorney, Agent, or Firm* — Fish & Richardson P.C.

(57) ABSTRACT

An ejection surface cleaning apparatus for cleaning a liquid ejection surface of a liquid ejection head ejecting an ejection liquid, includes: a cleaning liquid deposition device which deposits a cleaning liquid that dissolves or redisperses the ejection liquid, onto the liquid ejection surface; a wiping device which wipes the liquid ejection surface onto which the cleaning liquid has been deposited; and a control device which controls a leave time from deposition of the cleaning liquid onto the liquid ejection surface until wiping performed by the wiping device.

15 Claims, 17 Drawing Sheets

(56) References Cited

U.S. PATENT DOCUMENTS

2004/0246294 A1* 12/2004 Mitsuzawa ..... 347/23
2005/0162461 A1* 7/2005 Fujimori et al. ..... 347/33
2006/0066665 A1* 3/2006 Kachi et al. ..... 347/33
2007/0097170 A1* 5/2007 Sekiya et al. ..... 347/30
2008/0238990 A1* 10/2008 Inoue ..... 347/33

* cited by examiner

FIG.4

| INTERNAL AMBIENT RANGE OF APPARATUS | JOB TIME | REQUIRED LEAVE TIME A (SEC.) | CLEANING LIQUID DRYING TIME B (SEC.) | IMPLEMENTATION LEAVE TIME C (SEC.) | NUMBER OF IMPLEMENTATIONS D (TIMES) |
|---|---|---|---|---|---|
| FIRST RANGE | ~15 | 15 | 2000 | 15 | 1 |
| | ~30 | 30 | | 30 | 1 |
| | ~45 | 45 | | 45 | 1 |
| | ~60 | 60 | | 60 | 1 |
| SECOND RANGE | ~15 | 30 | 1000 | 30 | 1 |
| | ~30 | 60 | | 60 | 1 |
| | ~45 | 90 | | 90 | 1 |
| | ~60 | 120 | | 120 | 1 |
| THIRD RANGE | ~15 | 45 | 600 | 45 | 1 |
| | ~30 | 90 | | 90 | 1 |
| | ~45 | 135 | | 135 | 1 |
| | ~60 | 180 | | 180 | 1 |
| FOURTH RANGE | ~15 | 60 | 500 | 60 | 1 |
| | ~30 | 120 | | 120 | 1 |
| | ~45 | 180 | | 180 | 1 |
| | ~60 | 240 | | 240 | 1 |
| FIFTH RANGE | ~15 | 150 | 300 | 150 | 1 |
| | ~30 | 300 | | 300 | 1 |
| | ~45 | 450 | | 450 | 2 |
| | ~60 | 600 | | 600 | 2 |

FIG.5

| INTERNAL AMBIENT RANGE OF APPARATUS | JOB TIME | REQUIRED LEAVE TIME A (SEC.) | CLEANING LIQUID DRYING TIME B (SEC.) |
|---|---|---|---|
| FIRST RANGE | ~15 | 15 | 2000 |
| | ~30 | 30 | |
| | ~45 | 45 | |
| | ~60 | 60 | |
| SECOND RANGE | ~15 | 30 | 1000 |
| | ~30 | 60 | |
| | ~45 | 90 | |
| | ~60 | 120 | |
| THIRD RANGE | ~15 | 45 | 600 |
| | ~30 | 90 | |
| | ~45 | 135 | |
| | ~60 | 180 | |
| FOURTH RANGE | ~15 | 60 | 500 |
| | ~30 | 120 | |
| | ~45 | 180 | |
| | ~60 | 240 | |
| FIFTH RANGE | ~15 | 150 | 300 |
| | ~30 | 300 | |
| | ~45 | 450 | |
| | ~60 | 600 | |

FIG.6

| INTERNAL AMBIENT RANGE OF APPARATUS | REQUIRED LEAVE TIME A (SEC.) | CLEANING LIQUID DRYING TIME B (SEC.) | IMPLEMENTATION LEAVE TIME C (SEC.) | NUMBER OF IMPLEMENTATIONS D (TIMES) |
|---|---|---|---|---|
| FIRST RANGE | 60 | 2000 | 60 | 1 |
| SECOND RANGE | 120 | 1000 | 120 | 1 |
| THIRD RANGE | 180 | 600 | 180 | 1 |
| FOURTH RANGE | 240 | 500 | 240 | 1 |
| FIFTH RANGE | 600 | 300 | 300 | 2 |

EJECTION SURFACE CLEANING APPARATUS, LIQUID EJECTION APPARATUS AND EJECTION SURFACE CLEANING METHOD

BACKGROUND OF THE INVENTION

1. Field of the Invention

The present invention relates to an ejection surface cleaning apparatus, a liquid ejection apparatus and an ejection surface cleaning method, and more particularly, to technology for maintaining the liquid ejection surface of a liquid ejection head.

2. Description of the Related Art

In general, an inkjet recording apparatus which forms a desired image by ejecting ink droplets from an inkjet head onto a recording medium is widely used as a generic image forming apparatus.

An inkjet recording apparatus is able to record images of high resolution and high quality at relatively low cost and at high speed, and therefore such apparatuses are employed widely from recording onto small or medium-sized papers aimed at individual use, to recording onto large-sized papers, such as posters intended for outdoor display. For example, when recording onto large-size paper intended for outdoor display, aqueous pigment-based inks having light resistant properties are generally used.

In an inkjet recording apparatus, ink is liable to adhere to the ink ejection surface (nozzle surface) of the inkjet head, and if residual ink of this kind solidifies, then it can cause ejection abnormalities, such as abnormalities in the ink ejection volume or abnormalities in the ejection direction. In particular, with aqueous pigment-based ink, aggregation is liable to occur if the conditions are such that drying of the ink proceeds very rapidly, thus causing the ink adhering to the nozzle surface to solidify and leading to blocking of the nozzles and decline in printing quality. Consequently, it is necessary to carry out periodic maintenance (cleaning) of the ink ejection surface of the inkjet head.

Therefore, in order to resolve the problems described above, Japanese Patent Application Publication No. 2007-331166, for example, describes an inkjet recording apparatus according to which ink ejected from nozzles is recovered, the recovered waste ink is sprayed from a spray unit onto an ink ejection surface, and the ink ejection surface is wiped by a wiper. Furthermore, Japanese Patent Application Publication No. 2005-144737 describes an inkjet recording apparatus which sprays a cleaning liquid that dissolves or redisperses the ink, onto an ejection surface, wipes the ejection surface with a blade, and then suctions the ink via ejection holes.

However, in these apparatuses, if an aqueous pigment-based ink as described above is used, for example, then the ink is liable to dry and therefore cannot be removed adequately, and the remaining aggregated ink adheres again to the nozzles and the periphery of the nozzles, thus causing the print quality to decline. Moreover, since the state of the ink ejection surface changes each time an operation of wiping away the residual ink is carried out, then it is difficult to apply correction.

On the other hand, in order to remove solidified ink left adhering to a wiper blade in a reliable fashion, Japanese Patent Application Publication No. 2001-54949 describes an inkjet recording apparatus comprising a solution spraying device which sprays a solution capable of dissolving ink onto a wiping member, a leave time counting device which counts the leave time of the wiping member, and a wiping control device which controls a solution wiping operation by the solution spraying device.

However, if the wiping member cleaning technology described in Japanese Patent Application Publication No. 2001-54949 is applied to the cleaning of the ejection surface in order to remove solidified ink left adhering to the ink ejection surface of the inkjet recording apparatus described in Japanese Patent Application Publication No. 2007-331166 and Japanese Patent Application Publication No. 2005-144737, then since the leave time during which the cleaning liquid (solution) deposited onto the ink ejection surface is left on the ink ejection surface is a fixed time, problems of the following kind arise. More specifically, if the leave time of the cleaning liquid is set too short, then the ink adhering to the ink ejection surface is not wiped away sufficiently, and this gives rise to decline in printing quality. On the other hand, if the leave time of the cleaning liquid is too long, then time is spent unnecessarily on the maintenance operation and this give rise to decline in productivity. Furthermore, if the leave time of the washing liquid is set too long, then under high-temperature and low-humidity conditions, the cleaning liquid itself may dry out, and there is a possibility that a hard film may form over the whole of the ink ejection surface.

SUMMARY OF THE INVENTION

The present invention has been contrived in view of these circumstances, an object thereof being to provide an ejection surface cleaning apparatus, a liquid ejection apparatus and an ejection surface cleaning method, whereby the liquid ejection surface can be maintained in a good state, without reducing productivity.

In order to attain an object described above, one aspect of the present invention is directed to an ejection surface cleaning apparatus for cleaning a liquid ejection surface of a liquid ejection head ejecting an ejection liquid, comprising: a cleaning liquid deposition device which deposits a cleaning liquid that dissolves or redisperses the ejection liquid, onto the liquid ejection surface; a wiping device which wipes the liquid ejection surface onto which the cleaning liquid has been deposited; and a control device which controls a leave time from deposition of the cleaning liquid onto the liquid ejection surface until wiping performed by the wiping device.

According to this aspect of the invention, it is possible to set the leave time from the deposition of the cleaning liquid onto the liquid ejection surface of the liquid ejection head until the wiping by the wiping device to a suitable duration. Therefore, wasted time spent unnecessarily on the ejection surface cleaning process can be reduced, productivity can be improved, and furthermore, the liquid adhering to the liquid ejection surface can be removed and the liquid ejection surface can be maintained in a desirable state.

Desirably, the ejection surface cleaning apparatus further comprises a temperature and humidity determination device which determines temperature and humidity in a vicinity of the liquid ejection surface, wherein the control device sets the leave time according to the temperature and the humidity determined by the temperature and humidity determination device.

According to this aspect of the invention, it is possible to remove liquid adhering to the liquid ejection surface in a stable fashion, irrespectively of the internal ambient conditions of the apparatus (the temperature and humidity in the vicinity of the liquid ejection surface).

Desirably, the control device sets the leave time according to a required leave time which is a minimum time required to dissolve or redisperse the ejection liquid adhering to the liquid ejection surface with the cleaning liquid and to remove the ejection liquid from the liquid ejection surface by wiping performed by the wiping device, and sets a cleaning liquid drying time which is a maximum possible time for which the cleaning liquid deposited on the liquid ejection surface can be left without drying.

According to this aspect of the invention, since the leave time is set on the basis of the required leave time and the cleaning liquid drying time, which vary with the internal ambient conditions of the apparatus, then it is possible to carry out a more desirable ejection surface cleaning process.

Desirably, the control device sets the leave time at least so as not to exceed the cleaning liquid drying time.

According to this aspect of the invention, it is possible to prevent the formation of a hard film on the liquid ejection surface due to the drying of the cleaning liquid, and the liquid ejection surface can be maintained in a good state.

Desirably, when the required leave time is shorter than the cleaning liquid drying time, the control device sets the leave time so as to be equal to the required leave time.

According to this aspect of the invention, it is possible to reduce wasted time spent unnecessarily on the ejection surface cleaning process, and productivity can be improved.

Desirably, when the required leave time is longer than the cleaning liquid drying time, the control device divides an ejection surface cleaning process performed by the cleaning liquid deposition device and the wiping device into a plurality of ejection surface cleaning operations, and sets the leave time of the cleaning liquid per operation so as to be equal to or less than the cleaning liquid drying time.

According to this aspect of the invention, it is possible to remove liquid which is adhering to the liquid ejection surface, as well as being able to prevent the formation of a hard film on the liquid ejection surface due to the drying of the cleaning liquid.

Desirably, the control device performs setting such that a product of the leave time and number of implementations of the plurality of ejection surface cleaning operations is equal to the required leave time.

According to this aspect of the invention, it is possible to reduce wasted time spent unnecessarily on the ejection surface cleaning process, and productivity can be improved.

Desirably, the control device sets the leave time so as to be equal to the cleaning liquid drying time.

According to this aspect of the invention, it is possible to reduce the number of implementations of the ejection surface cleaning process. By this means, it is possible to reduce wasted time spent on the ejection surface cleaning process yet further, and therefore productivity can be improved yet further.

Desirably, the ejection surface cleaning apparatus further comprises a job time notification device which reports, to the control device, an implementation time of a latest job carried out by the liquid ejection head, wherein the control device sets the leave time according to the implementation time of the latest job reported from the job time notification device.

According to this aspect of the invention, it is possible to optimize the ejection surface cleaning process by setting the leave time in accordance with the job implementation time.

Desirably, the ejection surface cleaning apparatus further comprises: a temperature and humidity determination device which determines temperature and humidity in a vicinity of the liquid ejection surface; and a job time notification device which reports, to the control device, an implementation time of a latest job carried out by the liquid ejection head, wherein the control device sets the leave time according to the temperature and the humidity determined by the temperature and humidity determination device, a required leave time which is a minimum time required to dissolve or redisperse the ejection liquid adhering to the liquid ejection surface with the cleaning liquid and to remove the ejection liquid from the liquid ejection surface by wiping performed by the wiping device, a cleaning liquid drying time which is a maximum possible time for which the cleaning liquid deposited on the liquid ejection surface can be left without drying, and the implementation time of the latest job reported from the job time notification device.

Desirably, the required leave time is determined according to the temperature and the humidity determined by the temperature and humidity determination device and the implementation time of the latest job reported from the job time notification device.

Desirably, the cleaning liquid drying time is derived from the temperature and the humidity determined by the temperature and humidity determination device.

Desirably, the ejection surface cleaning apparatus further comprises a memory storing a cleaning process data table associating the leave time and number of implementations of ejection surface cleaning operations into which an ejection surface cleaning process performed by the cleaning liquid deposition device and the wiping device is divided, with the temperature and the humidity in the vicinity of the liquid ejection surface and the implementation time of the latest job carried out by the liquid ejection head, the leave time and the number of implementations of the ejection surface cleaning operations being determined based on the required leave time and the cleaning liquid drying time calculated from the temperature and the humidity in the vicinity of the liquid ejection surface and the implementation time of the latest job carried out by the liquid ejection head, wherein the control device acquires the leave time and the number of implementations of the ejection surface cleaning operations, from the temperature and the humidity determined by the temperature and humidity determination device and the implementation time of the latest job reported from the job time notification device with reference to the cleaning process data table.

Desirably, the ejection surface cleaning apparatus further comprises a memory storing a cleaning process data table associating the required leave time and the cleaning liquid drying time with the temperature and the humidity in the vicinity of the liquid ejection surface and the implementation time of the latest job carried out by the liquid ejection head, wherein the control device acquires the required leave time and the cleaning liquid drying time from the temperature and the humidity determined by the temperature and humidity determination device and the implementation time of the latest job reported from the job time notification device with reference to the cleaning process data table, and calculates the leave time and number of implementations of ejection surface cleaning operations into which an ejection surface cleaning process performed by the cleaning liquid deposition device and the wiping device is divided, from the acquired required leave time and the acquired cleaning liquid drying time.

Desirably, the ejection surface cleaning apparatus further comprises a memory storing a cleaning process data table associating the leave time and number of implementations of ejection surface cleaning operations into which an ejection surface cleaning process performed by the cleaning liquid deposition device and the wiping device is divided, with the temperature and the humidity in the vicinity of the liquid ejection surface and the implementation time of the latest job carried out by the liquid ejection head, the leave time and the number of implementations of the ejection surface cleaning operations being determined based on the required leave time and the cleaning liquid drying time calculated from the temperature and the humidity in the vicinity of the liquid ejection surface and one implementation time of the latest job carried out by the liquid ejection head, wherein the control device acquires the leave time and the number of implementations of the ejection surface cleaning operations from the temperature and the humidity determined by the temperature and humidity determination device with reference to the cleaning process data table.

In order to attain an object described above, another aspect of the present invention is directed to a liquid ejection apparatus, comprising: a liquid ejection head which ejects an ejection liquid; and any one of the ejection surface cleaning apparatuses described above.

One example of a liquid ejection apparatus is an inkjet recording apparatus which comprises an inkjet head that ejects ink, as a liquid ejection head, and which forms desired images on a recording medium.

In order to attain an object described above, another aspect of the present invention is directed to an ejection surface cleaning method of cleaning a liquid ejection surface of a liquid ejection head ejecting an ejection liquid, the ejection surface cleaning method comprising the steps of: depositing a cleaning liquid that dissolves or redisperses the ejection liquid, onto the liquid ejection surface; and wiping the liquid ejection surface onto which the cleaning liquid has been deposited, with a wiping device, wherein a leave time from deposition of the cleaning liquid onto the liquid ejection surface until wiping performed by the wiping device is controlled.

According to the present invention, it is possible to set the leave time from the deposition of the cleaning liquid onto the liquid ejection surface of the liquid ejection head until the wiping by the wiping device to a suitable duration. Therefore, wasted time spent unnecessarily on the ejection surface cleaning process can be reduced, productivity can be improved, and furthermore, the liquid adhering to the liquid ejection surface can be removed and the liquid ejection surface can be maintained in a desirable state.

BRIEF DESCRIPTION OF THE DRAWINGS

FIG. 4 is a diagram showing one example of a cleaning process data table;

FIG. 5 is a diagram showing a further example of a cleaning process data table;

FIG. 6 is a diagram showing yet a further example of a cleaning process data table;

BRIEF DESCRIPTION OF THE DRAWINGS

Composition of Ejection Surface Cleaning Apparatus

Figure 1:
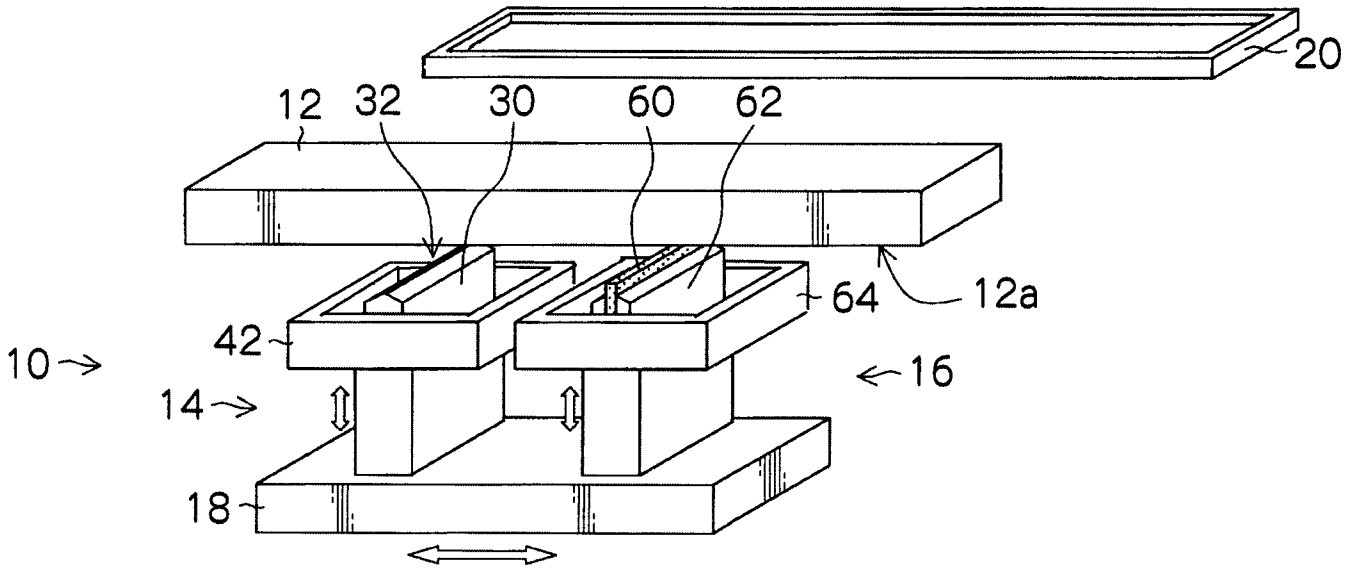
FIG. 1 is a perspective diagram showing the general composition of an ejection surface cleaning apparatus relating to an embodiment of the present invention.
Figure 2:
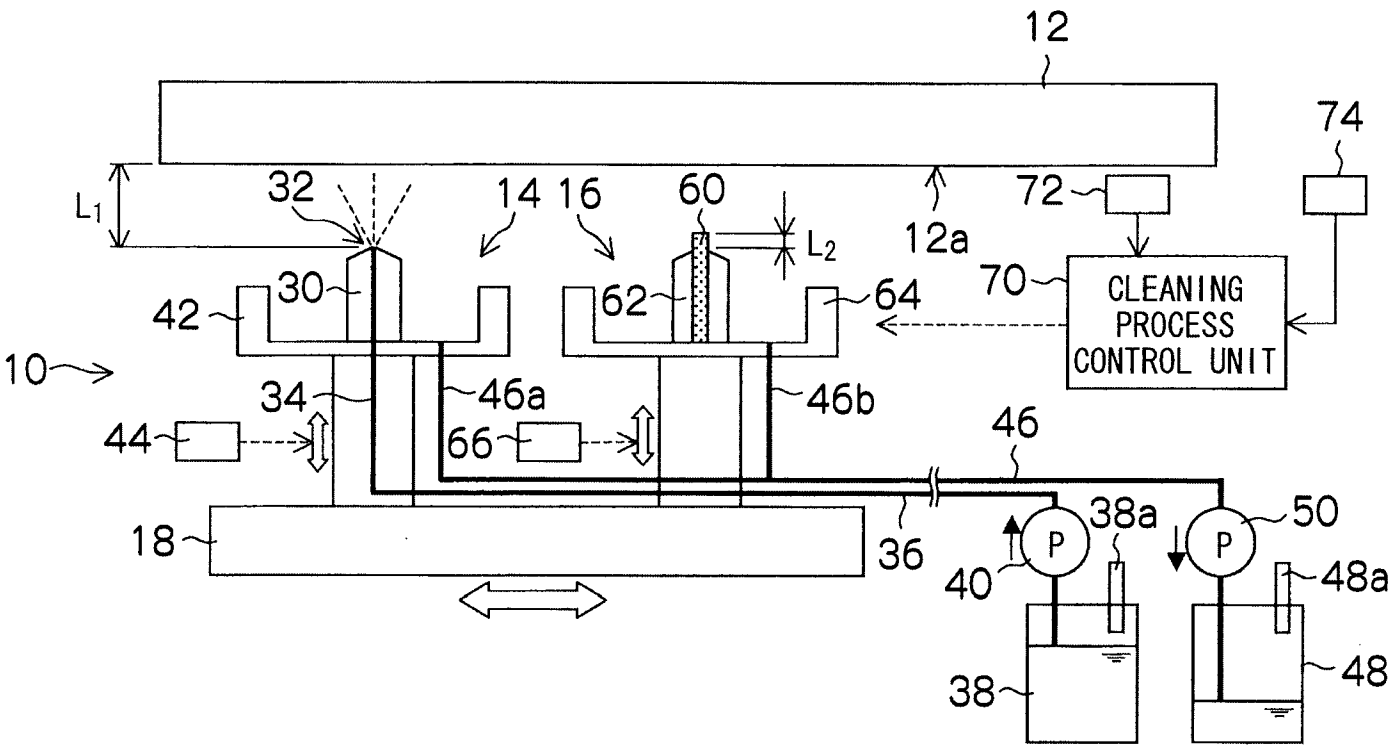
FIG. 2 is a front side diagram showing the general composition of an ejection surface cleaning apparatus relating to an embodiment of the present invention.

FIG. 1 is a perspective diagram showing the approximate composition of an ejection surface cleaning apparatus (hereinafter, called "cleaning apparatus") 10 relating to an embodiment of the present invention, and FIG. 2 is a front side view of same.

As shown in FIG. 1 and FIG. 2, this cleaning apparatus 10 comprises a cleaning liquid ejection deposition unit 14 which deposits cleaning liquid onto a liquid ejection surface (nozzle surface) 12*a* of a liquid ejection head (inkjet head) 12 provided in a liquid ejection apparatus, such as an inkjet recording apparatus, and an ejection surface wiping unit 16 which wipes the liquid ejection surface (hereinafter called "ejection surface") 12*a* of the liquid ejection head (hereinafter, called "head") 12 with a wiping device. The cleaning apparatus 10 carries out a cleaning process of the ejection surface 12*a* of the head 12 by wiping the ejection surface 12*a* on which washing liquid has been deposited, with a wiping device, when a prescribed time period (more specifically, a cleaning liquid leave time) has elapsed after depositing the cleaning liquid on the ejection surface 12*a* of the head 12. A cleaning process control unit 70 which controls the operations of the respective units is connected to the cleaning apparatus 10 and various operations relating to the cleaning process described above are carried out under the control of this cleaning process control unit 70.

The cleaning apparatus 10 is composed so as to move relatively with respect to the head 12 between a maintenance position directly below the head 12 and a withdrawn position where the apparatus is withdrawn from directly below the head 12. In other words, either the cleaning apparatus 10 is composed so as to be movable, or the cleaning apparatus 10 is fixed and the head 12 is composed so as to be movable. While liquid ejection is being performed by the head 12, the cleaning apparatus 10 is disposed in the withdrawn position, and when maintenance of the head 12 (an ejection surface cleaning process, and the like) is being carried out, the cleaning apparatus 10 is disposed in the maintenance position directly below the head 12. FIG. 1 and FIG. 2 show a state where the cleaning apparatus 10 is disposed in a maintenance position.

In the present example, the cleaning liquid deposition unit 14 and the ejection surface wiping unit 16 are mounted on the same carriage 18 and are composed to be movable reciprocally with respect to the head 12 in a plane parallel to the ejection surface 12*a*, in the lengthwise direction of the head 12 (main scanning direction; the horizontal direction in FIG. 1), being driven by a motor which is not illustrated.

A cap 20 is provided in the peripheral area of the head 12 and forms a device for preventing drying of the nozzles formed in the ejection surface 12*a* of the head 12 and preventing increase in the viscosity of the ink in the vicinity of the nozzles (see FIG. 1). This cap 20 is composed so as to be relatively movable with respect to the head 12 by means of a movement mechanism (not illustrated). The ejection surface 12*a* is covered with the cap 20 when the power supply is switched off or the printer is at standby, by moving the cap 20 or the head 12 to a prescribed position and fitting the cap 20 tightly to the head 12 (although there is a gap between the ejection surface 12*a* and the cap 20). Furthermore, in a state where the ejection surface 12*a* of the head 12 is covered by the cap 20, preliminary ejection (pressurized purging) is carried out towards the cap 20 in order to expel degraded ink in the vicinity of the nozzles (ink which has increased in viscosity) by applying pressure to the ink inside the head 12.

The cleaning liquid deposition unit 14 comprises a spraying apparatus 30 forming a cleaning liquid spraying device which sprays cleaning liquid in the form of a mist onto the ejection surface 12*a* of the head 12, and a liquid collecting vessel 42 which collects cleaning liquid that has not adhered to the ejection surface 12*a* and has dropped down vertically, of the cleaning liquid sprayed from the spraying apparatus 30.

A spray opening 32 from which the cleaning liquid is sprayed is opened in the upper portion (the ejection surface 12*a* side) of the spraying apparatus 30, and a liquid flow channel 34 connecting to the spray opening 32 is provided inside the spraying apparatus 30. The spray opening 32 is in the shape of a slit having a width equal to the wiping width of the wiping device which is provided in the ejection surface wiping unit 16 (in the present embodiment, the blade 60). The shape of the spray opening 32 is not limited to a slit shape, and may adopt various different shapes, such as a circular shape or square shape, or the like. Furthermore, the spray opening 32 may also be constituted by a plurality of holes.

A supply port (not illustrated) is provided on one end of the liquid flow channel 34, and one end of a supply tube 36 is connected to the supply port. The other end of this supply tube 36 is connected to the supply tank 38 and a supply pump 40 is provided at an intermediate portion of the supply tube. An air connection hole 38*a* is formed in the supply tank 38, whereby the interior of the tank is connected to the outside air. A cleaning liquid which dissolves or redisperses the ink used by the liquid ejection head 12 is stored inside the supply tank 38 and the cleaning liquid in the supply tank 38 is supplied to the liquid flow channel 34 via the supply tube 36 in accordance with the driving of the supply pump 40.

Furthermore, although not shown in the drawings, a vibration generating device, such as a piezoelectric element, is provided inside the liquid flow channel 34, and the cleaning liquid inside the liquid flow channel 34 is converted into a mist by the ultrasonic vibrations produced by this vibration generating device, and the mist is sprayed from the spray opening 32. According to the spraying apparatus 30 of the present embodiment, fine liquid droplets are sprayed by means of the vibrational pressure (vibrational energy) used to convert the liquid into a mist alone, without using pressurization by means of a pump, or the like, and therefore the fine liquid droplets do not penetrate deeply inside the nozzles (indicated by reference numeral 251 in FIGS. 16A to 16C) of the head 12, and the meniscus is not broken down.

The liquid collecting vessel 42 is a vessel having a concave shape which an opening on the upward side (the side of the ejection surface 12*a*), which is disposed between the spray opening 32 and the carriage 18, and when observed in planar view, the side walls of the liquid collecting vessel 42 are formed so as to surround the periphery of the spray opening 32. By this means, the cleaning liquid which has not adhered to the ejection surface 12*a* and which has dropped down vertically, of the cleaning liquid sprayed from the spray opening 32 (including ink which has been dissolved or redispersed by the cleaning liquid), is collected inside the liquid collecting vessel 42, thereby preventing soiling of the interior of the liquid ejection apparatus by the cleaning liquid, or the like.

In the present embodiment, desirably, the spray opening 32 is positioned in close proximity to the ejection surface 12*a* of the head 12, when cleaning liquid is sprayed from the spray opening 32. More specifically, the distance $L_1$ between the spray opening 32 and the ejection surface 12*a* is desirably 0.5 to 2.0 mm, and more desirably, 0.7 to 1.0 mm. In the present example, this distance is taken to be 0.8 mm. By disposing the spray opening 32 in close proximity to the ejection surface 12*a* of the head 12 in this way, it is possible to cause the cleaning liquid to adhere to the ejection surface 12*a* without loss of cleaning liquid (fine liquid droplets) which is sprayed from the spray opening 32 in the form of a mist.

If the spray opening 32 is too close to the ejection surface 12*a*, then there is a concern that the spraying apparatus 30 may touch the head 12, and therefore precision is required in the conveyance of the carriage 18 and costs increase. Consequently, from the viewpoint of the fine droplet generating capacity of the spraying apparatus 30 and cost considerations, the distance $L_1$ between the spray opening 32 and the ejection surface 12*a* is desirably set within the range described above.

Furthermore, in the present embodiment, a spray apparatus elevator mechanism 44 capable of raising and lowering the spraying apparatus 30 with respect to the head 12 is provided, and hence the distance $L_1$ between the spray opening 32 and the ejection surface 12*a* can be altered. Consequently, if the spray volume of the cleaning liquid from the spraying apparatus 30 is small, then it is possible to increase the amount of cleaning liquid deposited onto the ejection surface 12*a* by moving the spray opening 32 close to the ejection surface 12*a*. On the other hand, if the spray volume of the cleaning liquid is large, then it is possible to reduce the amount of cleaning liquid deposited onto the ejection surface 12*a* by moving the spray opening 32 away from the ejection surface 12*a*. By altering the distance $L_1$ between the spray opening 32 and the ejection surface 12*a* in accordance with the spray volume of the cleaning liquid in this way, it is possible to optimize the amount of cleaning liquid deposited onto the ejection surface 12*a*. Furthermore, it becomes possible to apply the cleaning liquid in the form of a mist (fine liquid droplets) to the ejection surface 12*a* of the head 12, with good efficiency, and therefore soiling of the interior of the liquid ejection apparatus due to the cleaning liquid, and the like, can be prevented.

Furthermore, in the present embodiment, the speed of movement of the carriage 18 on which the spraying apparatus 30 is mounted can be altered in accordance with the spray volume of cleaning liquid from the spraying apparatus 30. Therefore, if the spray volume of the cleaning liquid by the spraying apparatus 30 is small, it is possible to increase the amount of cleaning liquid deposited onto the ejection surface 12*a* by increasing the time during which the cleaning liquid is sprayed onto the ejection surface 12*a* by slowing the speed of movement of the carriage 18. Conversely, if the spray volume of the cleaning liquid is large, then it is possible to reduce the amount of cleaning liquid deposited onto the ejection surface

12*a* by shortening the time during which the cleaning liquid is sprayed onto the ejection surface 12*a* by raising the speed of movement of the carriage 18. By changing the speed of movement of the carriage 18 on which the spraying apparatus 30 is mounted, in addition to altering the distance $L_1$ between the spray opening 32 and the ejection surface 12*a*, in accordance with the spray volume of the cleaning liquid in this way, it is possible to optimize the amount of cleaning liquid deposited onto the ejection surface 12*a* even more precisely.

A more desirable mode of the present embodiment has a composition which combines a mode where the distance $L_1$ between the spray opening 32 and the ejection surface 12*a* can be altered in accordance with the spray volume of the cleaning liquid by the spraying apparatus 30 and a mode where the speed of movement of the carriage 18 can be altered. The present invention is not limited to this composition, and a composition having either one of the above-mentioned modes is also desirable. In the case of the present composition, it is possible to simplify the control of the amount of cleaning liquid deposited onto the ejection surface 12*a* of the head 12.

A blade 60 forming a wiping device, a blade holder 62 which holds this blade 60 and a liquid collecting vessel 64 which collects the ink wiped by the blade 60 are provided in the ejection surface wiping unit 16.

The blade 60 is a plate-shaped member having substantially the same width as the width of the liquid ejection surface 12*a* of the head 12 (the length in the direction perpendicular to the plane of the drawing in FIG. 1), and is made of an ink-repelling (lyophobic) material having elasticity, such as silicone rubber, silicon resin, or the like.

The blade holder 62 is a member which holds the base end portion of the blade 60 (the lower side portion in FIG. 1). In the present embodiment, the length $L_2$ of the front end portion of the blade 60 (the portion of the blade 60 apart from the base end portion which is held by the blade holder 62, in other words, the portion of the blade 60 which projects from the blade holder 62) is approximately 6 mm.

In the present embodiment, a blade elevator mechanism 66 is provided which moves the blade holder 62 that holds the blade 60 in the liquid ejection direction of the head 12 (the upward/downward direction in FIG. 2), so as to alter the distance between the blade 60 and the ejection surface 12*a*. By moving the blade holder 62 upwards, the blade 60 makes contact with (abuts against) the ejection surface 12*a* and the ejection surface 12*a* is wiped by the blade 60 due to the movement of the carriage 18. On the other hand, by moving the blade holder 62 downwards, the blade 60 is separated from the ejection surface 12*a* and even if the carriage 18 is moved when cleaning liquid is being sprayed by the spraying apparatus 30, the ejection surface 12*a* is not wiped by the blade 60. In this way, it is possible to switch the blade 60 between a state of contacting (abutting against) the ejection surface 12*a* and a state of being separated from the ejection surface 12*a*, by means of the blade elevator mechanism 66, and the time period from the spraying of cleaning liquid onto the ejection surface 12*a* by the spraying apparatus 30 until the wiping of the ejection surface 12*a* by the blade 60 (in other words, the cleaning liquid leave time) can be changed.

The liquid collecting vessel 64 is a vessel having a concave shape with an opening on the upper side (the side of the ejection surface 12*a*), which is disposed between the blade 60 and the carriage 18, and when observed in planar view, the side walls of the liquid collecting vessel 64 are formed so as to surround the periphery of the blade 60. Consequently, the ink wiped by the blade 60 is collected inside the liquid collecting vessel 64, and soiling of the interior of the liquid ejection apparatus by the ink wiped by the blade 60 is prevented.

One end of a recovery tube 46 is branched into two flow channels (branch flow channels) 46*a*, 46*b*, and the front end portion of each of the branch flow channels 46*a*, 46*b* is connected respectively to a discharge port (not illustrated) which is formed in the base portion of the respective liquid collecting vessels 42 and 64. The other end of this recovery tube 46 is connected to a recovery tank 48 and a recovery pump 50 is provided at an intermediate portion of the recovery tube. An air connection hole 48*a* is formed in the recovery tank 48, whereby the interior of the tank is connected to the outside air. By driving the recovery pump 50, the liquid (ink and cleaning liquid) collected inside the respective liquid collecting vessels 42 and 64 is recovered into the recovery tank 48 via the recovery tube 46.

The cleaning process control unit 70 functions as a control device for controlling the various units which make up the ejection surface cleaning apparatus 10, such as the spraying apparatus 30, the carriage 18, the spraying apparatus elevator mechanism 44, the blade elevator mechanism 66, the supply pump 40, the recovery pump 50, and the like. For example, the distance $L_1$ between the spray opening 32 and the ejection surface 12*a* can be varied by controlling the driving of the spray apparatus elevator mechanism 44 and the speed of movement of the carriage 18 can be varied by controlling the drive mechanism (not illustrated) of the carriage 18, in accordance with the spray volume of cleaning liquid.

The present embodiment is described in relation to a mode where a liquid spraying device (spraying apparatus 30) is provided as a device for depositing cleaning liquid onto the ejection surface 12*a* of a head 12, but the present invention is not limited to this and it is also possible, for example, to provide a cleaning liquid application device which applies cleaning liquid by bringing an application roller into contact with the ejection surface 12*a*, instead of a liquid spraying device.

Furthermore, the present embodiment is described in relation to a mode where a blade member (blade 60) is provided as a wiping device for wiping the ejection surface 12*a* of the head 12, but the present invention is not limited to this and it is also possible, for example, to provide a web-shaped member, such as a non-woven cloth, instead of the blade member.

Furthermore, in the present embodiment, the cleaning liquid deposition unit 14 and the ejection surface wiping unit 16 are mounted on the same carriage 18, but these units may also be mounted respectively on different carriages. According to this mode, the cleaning liquid deposition unit 14 and the ejection surface wiping unit 16 become movable reciprocally and mutually independently in the lengthwise direction of the head 12, the set length of the time period from the deposition of the cleaning liquid onto the ejection surface 12*a* of the head 12 until the wiping of the ejection surface 12*a* by the wiping device can be increased, and the cleaning efficiency can be improved yet further.

Next, the operation of the cleaning apparatus 10 will be described.

When a cleaning process of the ejection surface 12*a* of the head 12 is carried out, the cleaning apparatus 10 is positioned in the maintenance position directly below the head 12. The carriage 18 is moved relatively with respect to the head 12 while cleaning liquid is sprayed from the spraying apparatus 30 of the cleaning liquid deposition unit 14, thereby depositing cleaning liquid onto the ejection surface 12*a* of the head 12. In this case, the blade 60 is disposed in a position distant from the ejection surface 12*a* and wiping of the ejection surface 12*a* by the blade 60 is not carried out.

Subsequently, after the cleaning liquid has been deposited on the ejection surface 12*a* of the head 12, the apparatus enters a standby state until the prescribed time period (leave time) has elapsed. This leave time is set to be longer than the minimum time required to dissolve or redisperse ink adhering to the ink ejection surface 12*a* of the head 12 and to wipe away the ink by wiping by a blade 60 (required leave time A). This is because if the cleaning liquid leave time is set to be shorter than the required leave time A, then it is not possible to wipe away the ink adhering to the ejection face 12*a* adequately and printing quality therefore declines.

When the aforementioned leave time has elapsed, the blade 60 is disposed in a position which contacts (abuts against) the ejection surface 12*a* by means of the blade elevator mechanism 66, and the ejection surface 12*a* is wiped by the blade 60 while moving the carriage 18 relatively with respect to the head 12, thereby removing the ink adhering to the ejection surface 12*a*.

In the ejection surface cleaning process of this kind, if the leave time of the cleaning liquid is set to be unnecessarily long, then time is spent unnecessarily on the maintenance operation and this give rise to decline in productivity. Furthermore, if the leave time of the cleaning liquid is too long, then especially under conditions where the cleaning liquid deposited on the ejection surface 12*a* is liable to dry out, such as high-temperature and low-humidity conditions, there is a concern that a hard film will be formed on the ejection surface 12*a* by the dried cleaning liquid.

Figure 3:
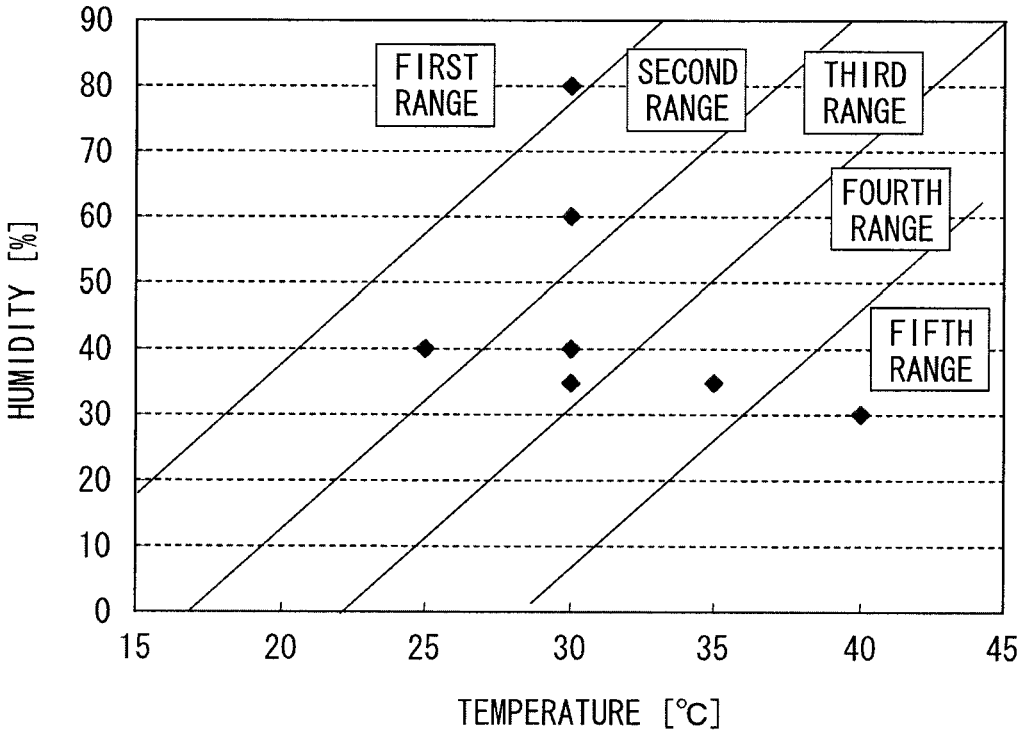
FIG. 3 is a graph showing one example of the relationship between the temperature and humidity and the drying speed of the cleaning liquid.

FIG. 3 is a graph showing one example of the relationship between the temperature and the humidity in a liquid ejection apparatus (in the vicinity of the ejection surface 12*a* of the head 12) and the drying speed of the cleaning liquid. Regions where the drying speed is the same (internal ambient ranges of the apparatus) were identified by dripping 10 μl of the liquid for measurement (in the present embodiment, the cleaning liquid) under prescribed temperature and humidity conditions, and determining the drying time until the weight thereof was reduced by 10%, and these ranges are respectively indicated as the first to fifth ranges in FIG. 3.

The interior ambient range of the apparatus is the "first range", for example, at 30° C. and 80%. Furthermore, at 30° C. and 60%, or 25° C. and 40%, this range is the "second range", in both of these cases, and the hence the drying speed is the same in both cases. The drying speed of the cleaning liquid becomes successively faster in sequence, from the first range, second range, third range, fourth range to the fifth range.

Since the drying speed of the cleaning liquid differs according to the internal ambient range of the apparatus in this way, then the maximum time that the cleaning liquid deposited onto the ejection surface 12*a* of the head 12 can be left without drying (cleaning liquid drying time B) also changes. Therefore, depending on the internal ambient conditions (temperature and humidity) of the apparatus, problems of the following kinds occur not only if the required leave time A is shorter than the cleaning liquid drying time B (A<B), but also if the required leave time A is longer than the cleaning liquid drying time B (A>B).

Firstly, in the former case (A<B), if the cleaning liquid leave time (implementation leave time C) is shorter than the required leave time A (C<A<B), then it is not possible to remove the ink adhering to the ejection surface 12*a*, sufficiently. Furthermore, if the implementation leave time C is longer than the cleaning liquid drying time B (A<B<C), then there is a possibility that a hard film will form over the whole of the ejection surface 12*a* due to the drying of the cleaning liquid. Moreover, if the implementation leave time C is between the required leave time A and the cleaning liquid drying time B (A<C<B), then if the implementation leave time C is too long, time is wasted unnecessarily on the ejection surface cleaning process and this leads to decline in productivity.

On the other hand, in the latter case (A>B), if the implementation leave time C is longer than the required leave time A (C>A>B), then the implementation leave time C will be longer than the cleaning liquid drying time B and there is a possibility that a hard film will be formed by the cleaning liquid over the whole of the ejection surface 12*a* due to the drying of the cleaning liquid. Furthermore, if the implementation leave time C is shorter than the cleaning liquid drying time B (A>B>C), then the implementation leave time C becomes shorter than the required leave time A, and the ink adhering to the ejection surface 12*a* cannot be removed sufficiently. Moreover, if the implementation leave time C is between the required leave time A and the cleaning liquid drying time B (A>C>B), then a hard film is formed over the whole of the ejection surface 12*a* due to the drying of the cleaning liquid, and furthermore the ink adhering to the ejection surface 12*a* cannot be removed sufficiently.

Therefore, in the present embodiment, in order to resolve the problems described above, the ejection surface cleaning process is optimized in the following ways in accordance with the internal ambient conditions of the apparatus (temperature and humidity).

Firstly, if the required leave time A is shorter than the cleaning liquid drying time B (A<B), then the implementation leave time C is set to be equal to the required leave time A (C=A). Therefore, the number of times to carry out the ejection surface cleaning process (number of implementations D) is set to one time (D=1). By this means, it is possible to reduce wasted time spent unnecessarily on the ejection surface cleaning process, and therefore productivity can be improved.

On the other hand, if the required leave time A is longer than the cleaning liquid drying time B (A>B), then the implementation leave time C is set to be equal to or less than the cleaning liquid drying time B (C≦B). The number of repeats of the ejection surface cleaning process (number of implementations D) is set to two or more times (D≧2). Here, the implementation leave time C and the number of implementations D are set in such a manner that the product of the implementation leave time C and the number of implementations D (the total leave time E) is equal to or greater than the required leave time A. Desirably, the implementation leave time C is set to the highest possible value within a range that does not exceed the cleaning liquid drying time B. This is because if the implementation leave time C is too short, then the number of implementations D becomes too great and the wasted time spent unnecessarily on the ejection surface cleaning process increases. In other words, more desirably, the implementation leave time C is equal to the cleaning liquid drying time B, whereby the number of implementations D can be reduced and the wasted time spent unnecessarily on the ejection surface cleaning process can be reduced.

A desirable setting method in the latter case (A>B) is one where the number of implementations D is a value found by dividing the required leave time A by the cleaning liquid drying time B (rounding up to the nearest integer). The implementation leave time C is set as the value obtained by dividing the required leave time A by the number of implementations D. By this means, the total leave time E (the product of the implementation leave time C and the number of implementations D) is set so as to be equal to the required leave time A, and as a result, wasted time spent unnecessarily on the ejection surface cleaning process can be reduced. It is therefore possible to improve productivity, as well as being able to remove all of the ink adhering to the ejection surface 12*a*. Furthermore, since the implementation leave time C is set to be equal to or less then the cleaning liquid drying time B, then a hard film does not form over the whole of the ejection surface 12*a* due to the drying of the cleaning liquid.

Here, in order to further understanding of the ejection surface cleaning process according to an embodiment of the present invention, the process is now described with reference to FIG. 4. FIG. 4 shows one example of a cleaning process data table which is used in the present embodiment. This cleaning process data table is stored in a memory (not illustrated), and the cleaning process control unit 70 refers to this memory as and when necessary and reads out the respective values in the cleaning process data table as appropriate.

The "internal ambient range of the apparatus" shown in FIG. 4 corresponds to the respective ranges (first to fifth ranges) shown in FIG. 3. If the internal temperature and humidity of the liquid ejection apparatus are 30° C. and 80%, for example, then the internal ambient range of the apparatus is the first range, whereas if these conditions are 40° C. and 30%, then it is the fifth range.

The "job time" means the implementation time of the latest print job carried out by the head 12. The required leave time A (the minimum time required in order to dissolve or redisperse the ink adhering to the ejection surface 12*a* and remove the ink from the ejection surface 12*a* by wiping by a blade 60) changes according to the job time, and therefore, in the example shown in FIG. 4, the required leave time A is segmented respectively for each internal ambient range of the apparatus and each job time. On the other hand, the cleaning liquid drying time B is independent of the magnitude of the job time and depends only on the internal ambient (temperature and humidity) conditions of the apparatus, and therefore is set respectively for each internal ambient range. Moreover, the implementation leave time C and the number of implementations D are set respectively for each value of the required leave time A and the cleaning liquid drying time B (in other words, each internal ambient range of the apparatus and each job time).

In FIG. 4, for example, if the internal ambient range of the apparatus is the first range and the job time is 30 minutes, then the required leave time A is 30 seconds and the cleaning liquid drying time B is 2000 seconds. In this case, since the required leave time A is shorter than the cleaning liquid drying time B (A<B), the implementation leave time C is 30 seconds which is the same as the required leave time A, and the number of implementations D is one. Accordingly, the cleaning liquid is deposited on the ejection surface 12*a* of the head 12 and left for 30 seconds, whereupon an ejection surface cleaning process of wiping by the blade 60 is carried out once only.

On the other hand, if the internal ambient range of the apparatus is the fifth range and the job time is 45 minutes, then the required leave time A is 450 seconds and the cleaning liquid drying time B is 300 seconds. In this case, since the required leave time A is longer than the cleaning liquid drying time B (A>B), the number of implementations D is a value obtained by dividing the required leave time A by the cleaning liquid drying time B and rounding up to the nearest integer (two times), and the implementation leave time C is a value obtained by dividing the required leave time A by the number of implementations D (225 seconds). The product of the implementation leave time C and the number of implementations D (the total leave time F) thereby becomes equal to the required leave time A. Accordingly, the cleaning liquid is deposited on the ejection surface 12*a* of the head 12 and left for 225 seconds, whereupon an ejection surface cleaning process of wiping by the blade 60 is carried out two times.

Values determined in advance by calculation are set for the implementation leave time C and the number of implementations D in the cleaning process data table, in such a manner that the cleaning process control unit 70 automatically reads out these values by referring to the cleaning process data table. Of course, it is also possible to determine the implementation leave time C and the number of implementations D by calculation as and when necessary from the required leave time A and the cleaning liquid drying time B which have been set in accordance with the internal ambient (temperature and humidity) conditions of the apparatus and the job time, but from the viewpoint of improving productivity, it is desirable to set values which have been calculated in advance in the cleaning process data table.

Furthermore, the relationships between the internal ambient range of the apparatus, the job time, the required leave time A, the cleaning liquid drying time B, the implementation leave time C and the number of implementations D vary with the type of ink used, and the like, and are not limited to the examples in FIG. 4.

In the present embodiment, in order to achieve the ejection surface cleaning process described above, as shown in FIG. 2, a temperature and humidity determination device 72 for determining the temperature and humidity in the vicinity of the ejection surface 12*a* of the head 12 is provided, and the determination results from the temperature and humidity determination device 72 are reported to the cleaning process control unit 70. In the cleaning process control unit 70, the ejection surface cleaning process is optimized on the basis of the temperature and humidity determined by the temperature and humidity determination device 72.

Furthermore, in the present embodiment, as shown in FIG. 2, a job time notification device 74 which reports the implementation time (hereinafter, called job time) of the latest print job carried out by the head 12 is also provided. Since the required leave time A of the cleaning liquid charges in accordance with the job time, in the present embodiment, the job time is reported to the cleaning process control unit 70 by the job time notification device 74. In the cleaning process control unit 70, the required leave time A is determined in accordance with the job time and the ejection surface cleaning process is optimized on the basis of this result.

FIG. 5 shows a further example of a cleaning process data table which is used in the present embodiment. In the example shown in FIG. 5, the implementation leave time C and the number of implementations D are not set in the cleaning process data table, but rather are derived as appropriate by calculation on the basis of the required leave time A and the cleaning liquid drying time B which are determined on the basis of the internal temperature and humidity of the apparatus and the job time.

FIG. 6 shows yet a further example of a cleaning process data table which is used in the present embodiment. In the example shown in FIG. 6, there is no column for the job time, and the required leave time A is set to a value corresponding to the maximum value of the job time in the example in FIG. 4. In other words, in the example shown in FIG. 6, for example, the required leave time A corresponding to the first range is set to 60 seconds, which is the maximum value in the example in FIG. 4. In the case of the present example, the level of optimization is inferior to that of the examples shown in FIG. 4 and FIG. 5, but no time is required to acquire the job time in the cleaning process control unit 70, the job time notification device 74 is not necessary, and therefore the apparatus composition and the control method, and the like, can be simplified.

In this way, according to the present embodiment, the ejection surface cleaning process is carried out in accordance with conditions for the ejection surface cleaning process (the implementation leave time C and the number of implementations D) which have been determined in accordance with the internal ambient (temperature and humidity) conditions of the apparatus and the job time, and therefore even in conditions whereby the cleaning liquid is liable to dry out, such as a high-temperature and low-humidity environment (for example, when the internal ambient range of the apparatus is the fifth range), a hard film does not form on the ejection surface 12*a* due to drying of the cleaning liquid, but rather the ink adhering to to the ejection surface 12*a* can be removed in a reliable fashion and decline in print quality due to inadequate maintenance is prevented. Moreover, wasted time spent unnecessarily on the ejection surface cleaning process can be reduced and productivity can therefore be improved.

Next, the control sequence inside a liquid ejection apparatus which incorporates the cleaning apparatus 10 according to the present embodiment will be described.

Figure 7:
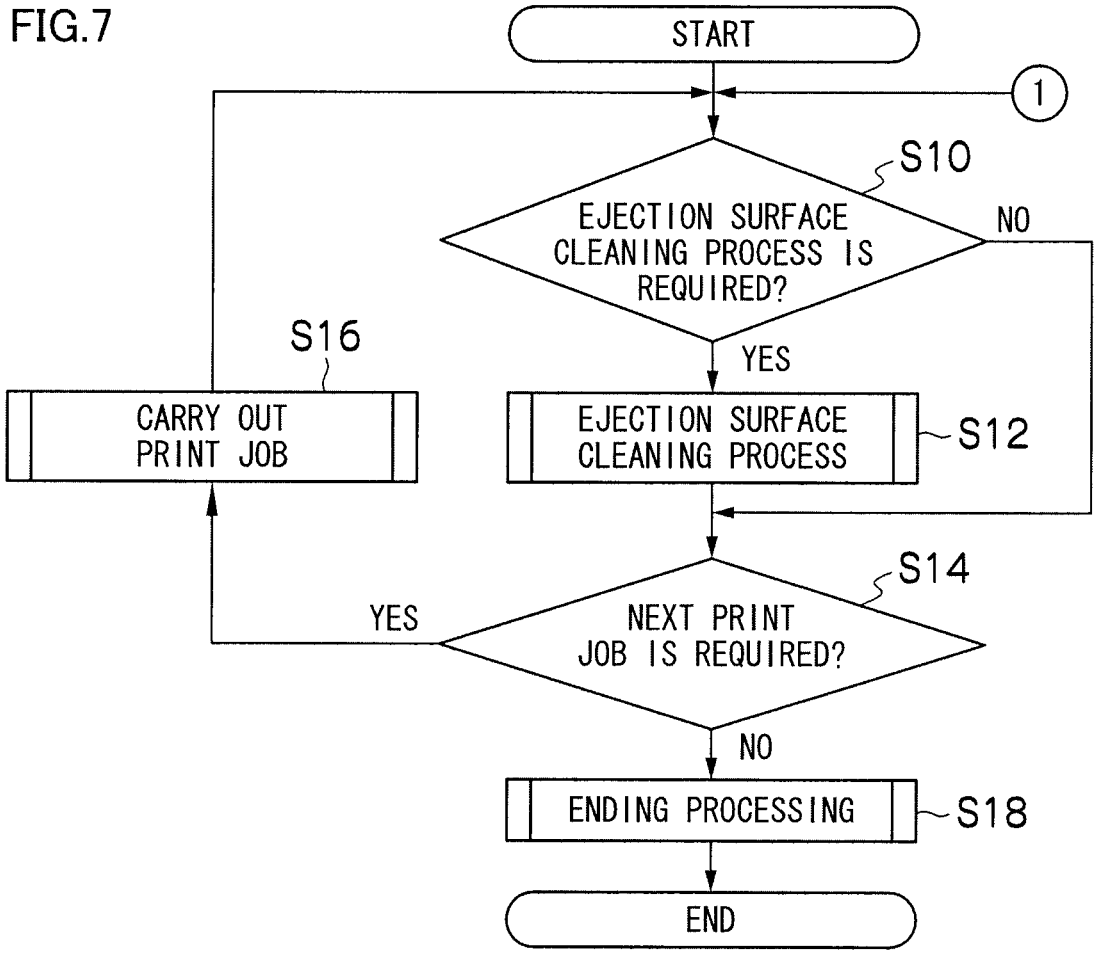
FIG. 7 is a diagram showing one example of a flowchart after the end of a print job.

FIG. 7 is a diagram showing one example of a flowchart after the end of a print job. The respective processes shown in FIG. 7 are carried out principally by the cleaning process control unit 70 shown in FIG. 2.

Firstly, when a print job ends, at step S10, it is judged whether or not an ejection surface cleaning process is necessary. If it is judged that an ejection surface cleaning process is necessary, then the procedure advances to step S12, whereas if it is judged that an ejection surface cleaning process is not necessary, then the procedure advances to step S14.

The judgment method used in step S10 may be based on providing a counting device which counts the elapsed time (cumulative uncleaned time) since the last time when the previous ejection surface cleaning process is carried out, and judges whether or not this cumulative uncleaned time exceeds a previously established reference time. In this case, if the cumulative uncleaned time exceeds the reference time, then it is judged that cleaning of the ejection surface 12*a* is necessary and if the cumulative uncleaned time is equal to or less than the reference time, then it is judged that the cleaning of the ejection surface 12*a* is not necessary. Furthermore, it is also possible to provide a monitoring device (for example, a CCD, or the like) which determines the state of soiling of the ejection surface 12*a* in such a manner that it can be judged whether or not the state of soiling determined by the monitoring device exceeds a previously established threshold value.

At step S12, an ejection surface cleaning process is carried out. The detailed sequence of the ejection surface cleaning process is described in detail below. When the ejection surface cleaning process has been completed, the procedure advances to step S14.

At step S14, it is judged whether or not there exists a subsequent print job. If it is judged that there is a subsequent print job, then the procedure advances to step S16 and the next print job is carried out. When this print job has been completed, the procedure advances to step S12, and similar processing is repeated thereafter. On the other hand, if it is judged that there is no subsequent print job, then the procedure advances to step S18 and prescribed ending (stand-down) processing is carried out (for example, cleaning of the ejection surface 12*a*, capping of the head 12, halting of ink circulation), and the present flowchart terminates.

Figure 8:
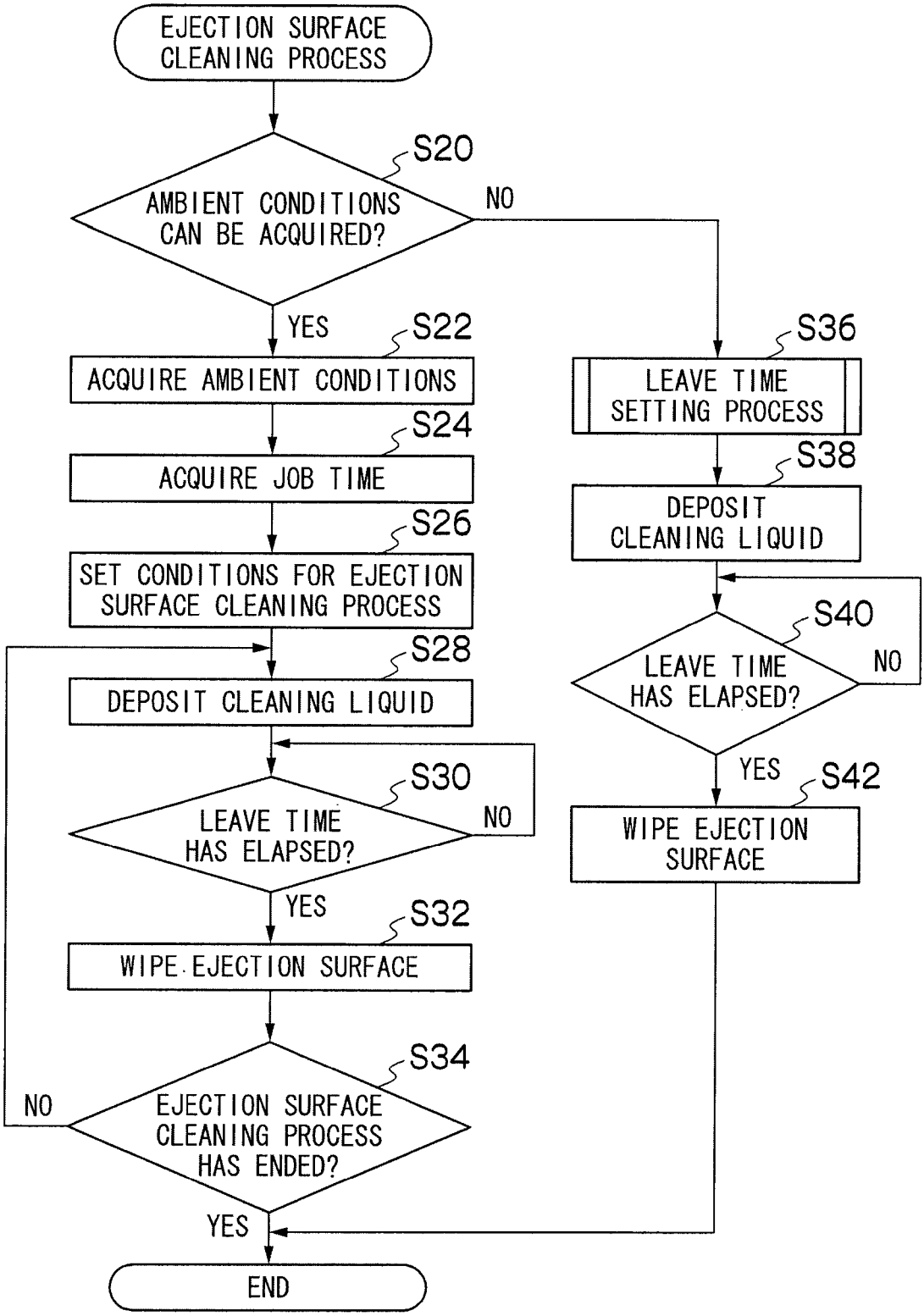
FIG. 8 is a flowchart showing the details of an ejection surface cleaning process.

FIG. 8 is a flowchart showing the details of the ejection surface cleaning process shown in step S12 in FIG. 7. Firstly, when an ejection surface cleaning process is started, at step S20, it is judged whether or not the internal temperature and humidity of the liquid ejection apparatus can be acquired as ambient conditions. In the present example, the temperature and humidity in the vicinity of the ejection surface 12*a* of the head 12 are determined by the temperature and humidity determination device 72 shown in FIG. 2, and the ambient conditions are acquired by reporting these results to the cleaning process control unit 70. If it is judged that the ambient conditions can be acquired, then the procedure advances to step S22. If, on the other hand, it is judged that the ambient conditions cannot be acquired, then the procedure advances to step S36.

At step S22, the ambient conditions are acquired as described above. In the subsequent step S24, the implementation time (job time) of the latest print job carried out by the head 12 is acquired. In the present example, the job time is acquired by means of the job time notification device 74 reporting the job time to the cleaning process control unit 70. The sequence of the respective processes shown in step S22 and step S24 may be reversed, or they may be carried out simultaneously.

At step S26, the conditions of the ejection surface cleaning process are set. More specifically, the implementation leave time C and the number of implementations D are determined automatically by referring to the memory where the data table shown in FIG. 4 is stored, on the basis of the ambient conditions (the internal temperature and humidity of the apparatus) acquired at step S22 and the job time acquired at step S24.

In the subsequent steps S28 to S34, the respective processes are carried out in accordance with the conditions (in other words, the implementation leave time C and number of implementations D) set in the previous step S26.

Firstly, in the initial step S28, cleaning liquid is deposited onto the ejection surface 12*a* of the head 12 by spraying cleaning liquid from the spraying apparatus 30. In the next step 30, a standby state is assumed until the implementation leave time C has elapsed. When the implementation leave time C has elapsed, at the next step S32, the ejection surface 12*a* is wiped with the blade 60. Furthermore, in the next step S34, it is judged whether or not the ejection surface cleaning process has been completed. More specifically, it is judged whether or not the number of times that the respective processes in steps S28 to S32 have been carried out has reached the number of implementations D determined at step S34, and if this number of times has not reached the number of implementations D, then the procedure returns to step S28 and similar processing is repeated. On the other hand, if the number of times has reached the number of implementations D, then the ejection surface cleaning process terminates.

If it is judged at step S20 that the ambient conditions cannot be acquired, then the procedure advances to step S36 and the leave time setting process is carried out. In the leave time setting process, a fixed value (default value) stored previously in a memory (not illustrated) inside the apparatus is set as the cleaning liquid leave time.

In the next step S38, similarly to step S28, cleaning liquid is deposited onto the ejection surface 12*a* of the head 12. In the next step S40, the apparatus assumes a standby state until the leave time set in the previous step S36 has elapsed. After the leave time has elapsed, in the next step S42, similarly to the step S32, the ejection surface 12*a* is wiped by the blade 60 and the ejection surface cleaning process terminates.

Figure 9:
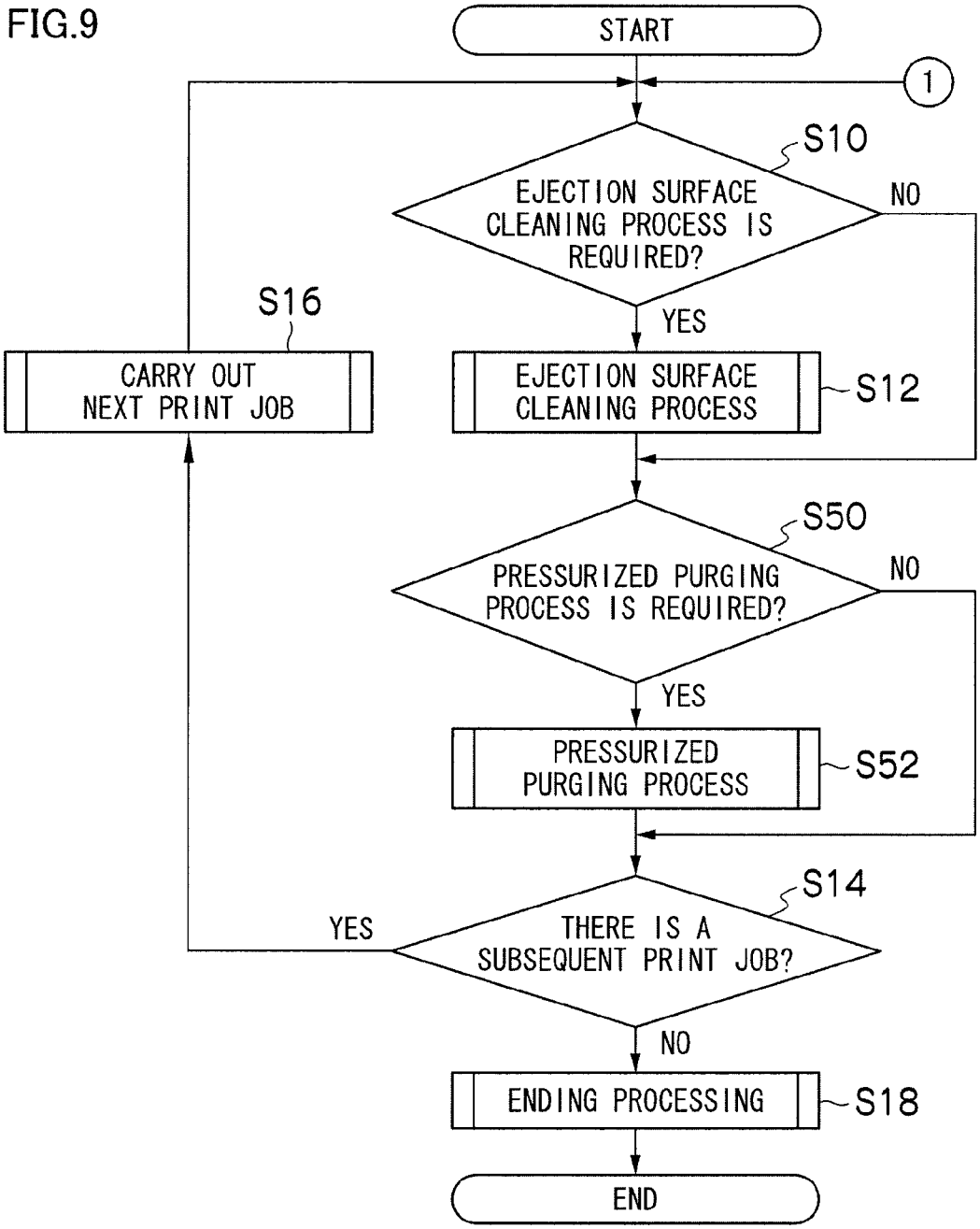
FIG. 9 is a diagram showing a further example of a flowchart after the end of a print job.

FIG. 9 is a diagram showing a further example of a flowchart after the end of a print job. In FIG. 9, processes which are the same as or similar to FIG. 7 to FIG. 8 are labelled with the same reference numerals and description thereof is omitted here.

In the example shown in FIG. 9, after the ejection surface cleaning process in step S12 has been executed, or when it is judged that the start of an ejection surface cleaning process is unnecessary in step S10, then in step S50, it is judged whether or not a pressurized purging process of the head 12 is necessary. If it is judged that a pressurized purging process is necessary, then the procedure advances to step S52, whereas if it is judged that a pressurized purging process is not necessary, then the procedure advances to step S14.

The judgment method in step S50 may, for example, be based on providing a device which determines ejection failure nozzles and carrying out a pressurized purging process if an ejection failure nozzle is determined by this device. Furthermore, since ejection failure nozzles are liable to occur if the non-operation time during which ink ejection is not performed from the nozzles of the head 12 exceeds a prescribed time period, then it is also possible to judge whether or not to carry out a pressurized purging process in accordance with the non-operation time.

At step S52, a pressurized purging process is carried out. In this pressurized purging process, the cap 20 is moved relatively with respect to the head 12, the ejection surface 12*a* of the head 12 is covered with a cap 20, the ink inside the head 12 is pressurized and the degraded ink in the vicinity of the nozzle is thereby discharged into the cap 20. When the pressurization purging process has been completed, the procedure advances to step S14.

According to the example shown in FIG. 9, since the pressurized purging process is carried out after carrying out the ejection surface cleaning process, then even if cleaning liquid infiltrates inside the nozzles of the head 12 when carrying out the ejection surface cleaning process, this cleaning liquid is discharged to the exterior by the pressurized purging process and therefore decline in the print quality can be avoided.

Figure 10:
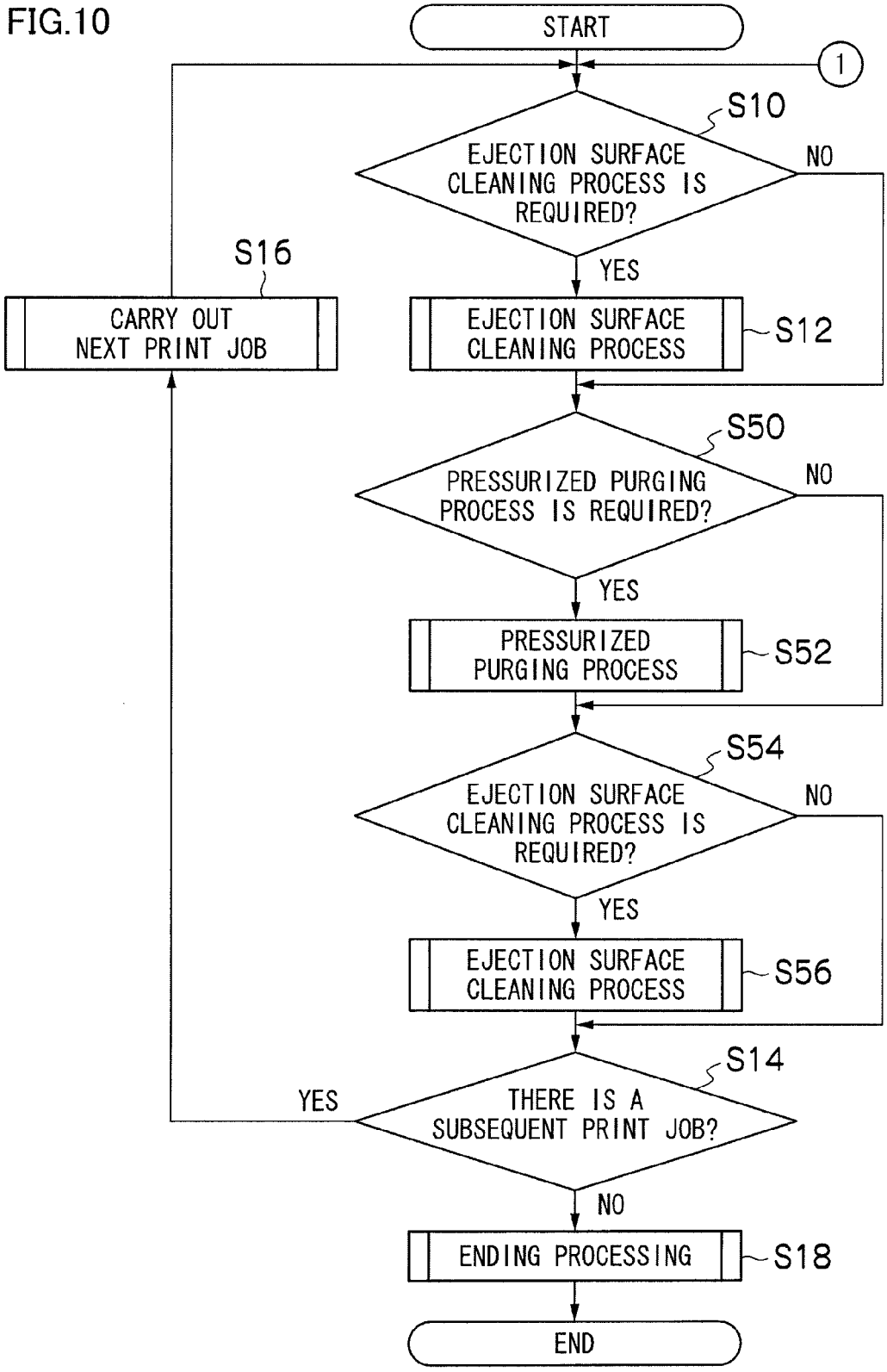
FIG. 10 is a diagram showing yet a further example of a flowchart after the end of a print job.

FIG. 10 is a diagram showing yet a further example of a flowchart after the end of a print job. In FIG. 10, processes which are the same as or similar to FIG. 7 to FIG. 9 are labelled with the same reference numerals and description thereof is omitted here.

In the example shown in FIG. 10, after the pressurized purging process in step S52 has been carried out, or when it is judged that the start of a pressurized purging process is unnecessary in step S50, then at step S54, it is judged whether or not an ejection surface cleaning process (second ejection surface cleaning process) is necessary. If it is judged that a second ejection surface cleaning process is necessary, then the procedure advances to step S56, whereas if it is judged that a second ejection surface cleaning process is not necessary, then the procedure advances to step S14.

At step S56, a second ejection surface cleaning process is carried out. In the second ejection surface cleaning process, a fixed value (default value) stored previously in a memory (not illustrated) inside the apparatus is set as the cleaning liquid leave time. The leave time of the cleaning set here is 1 to 5 seconds, for example (and more desirably, 2 to 3 seconds), and is set to a value which is much shorter than the cleaning liquid leave time (implementation leave time C) set in the ejection surface cleaning process in step S12 (the first ejection surface cleaning process). Consequently, cleaning liquid is deposited on the ejection surface 12*a* of the head 12 and after waiting until the leave time (default value) described above has elapsed, wiping by the blade 60 is carried out. In other words, the second ejection surface cleaning process is similar to the process in the steps S36 to S42 shown in FIG. 8. When the second ejection surface cleaning process has been completed, the procedure advances to step S14.

According to the example shown in FIG. 10, even if ink has adhered to the ejection surface 12*a* due to the pressurized purging process, the ink adhering to the ejection surface 12*a* is removed by the second ejection surface cleaning process which is carried out subsequently, and therefore it is possible to improve the print quality yet further.

Figure 11:
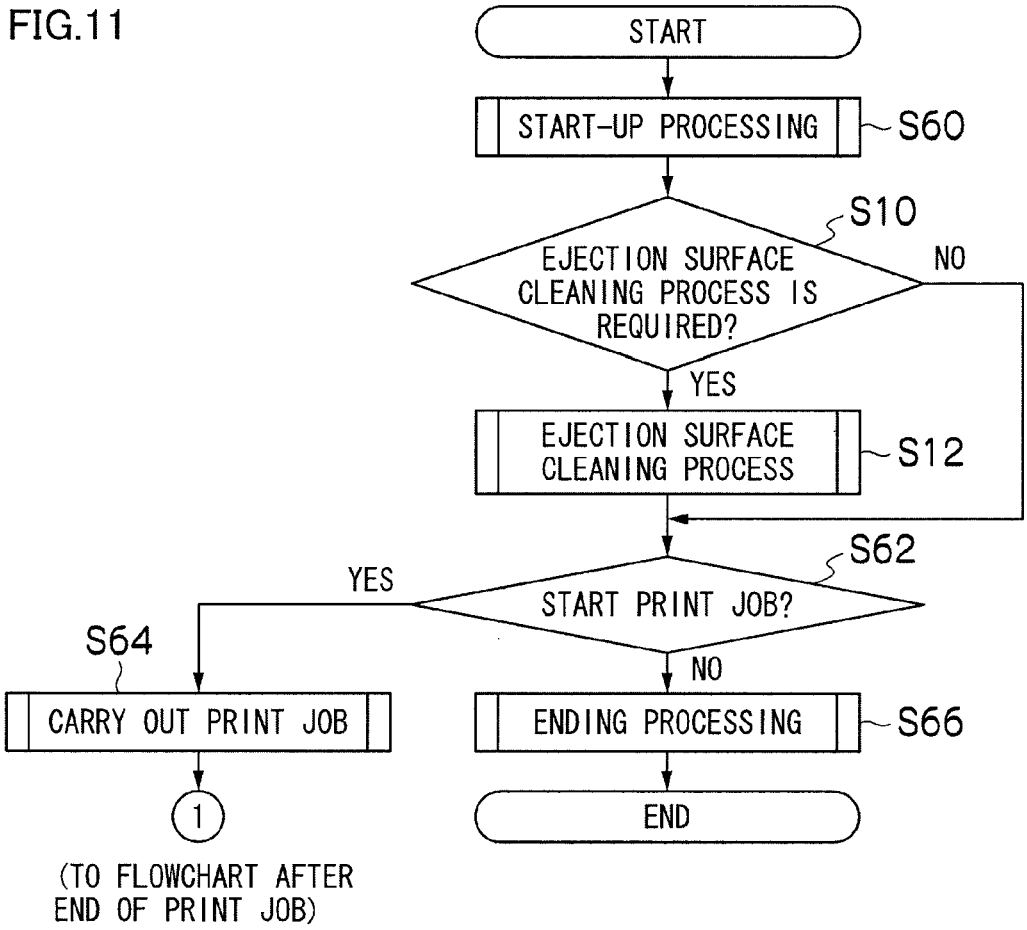
FIG. 11 is a diagram showing one example of a flowchart upon start-up of a liquid ejection apparatus.

FIG. 11 is a diagram showing one example of the flowchart when starting up the liquid ejection apparatus. In FIG. 11, processes which are the same as or similar to FIG. 7 to FIG. 10 are labelled with the same reference numerals and description thereof is omitted here.

When the liquid ejection apparatus is started up, firstly at step S60, a prescribed start-up process is carried out (for example, ink circulation, preparation of deaerated ink, ink temperature adjustment). When the start-up process has been completed, the procedure advances to step S10.

In step S10, it is judged whether or not an ejection surface cleaning process is necessary. If it is judged that an ejection surface cleaning process is necessary, the ejection surface cleaning process in step S12 is carried out and when this process has been completed, the procedure advances to step S62. On the other hand, if it is judged that an ejection surface cleaning process is unnecessary, then the procedure advances directly to step S62.

At step S62, it is judged whether or not a print job is to be started. When the print job is started, the procedure advances to step S64 and the print job is carried out. When the print job has been completed, processing is carried out in accordance with a flowchart after the completion of the print job (see FIG. 7, FIG. 9 or FIG. 10). On the other hand, if a print job is not to be started at step S62, then the procedure advances to step S66 and prescribed ending (stand-down) processing is carried out (for example, cleaning of the ejection surface 12*a*, capping of the head 12, halting of ink circulation), and the present flowchart terminates.

Figure 12:
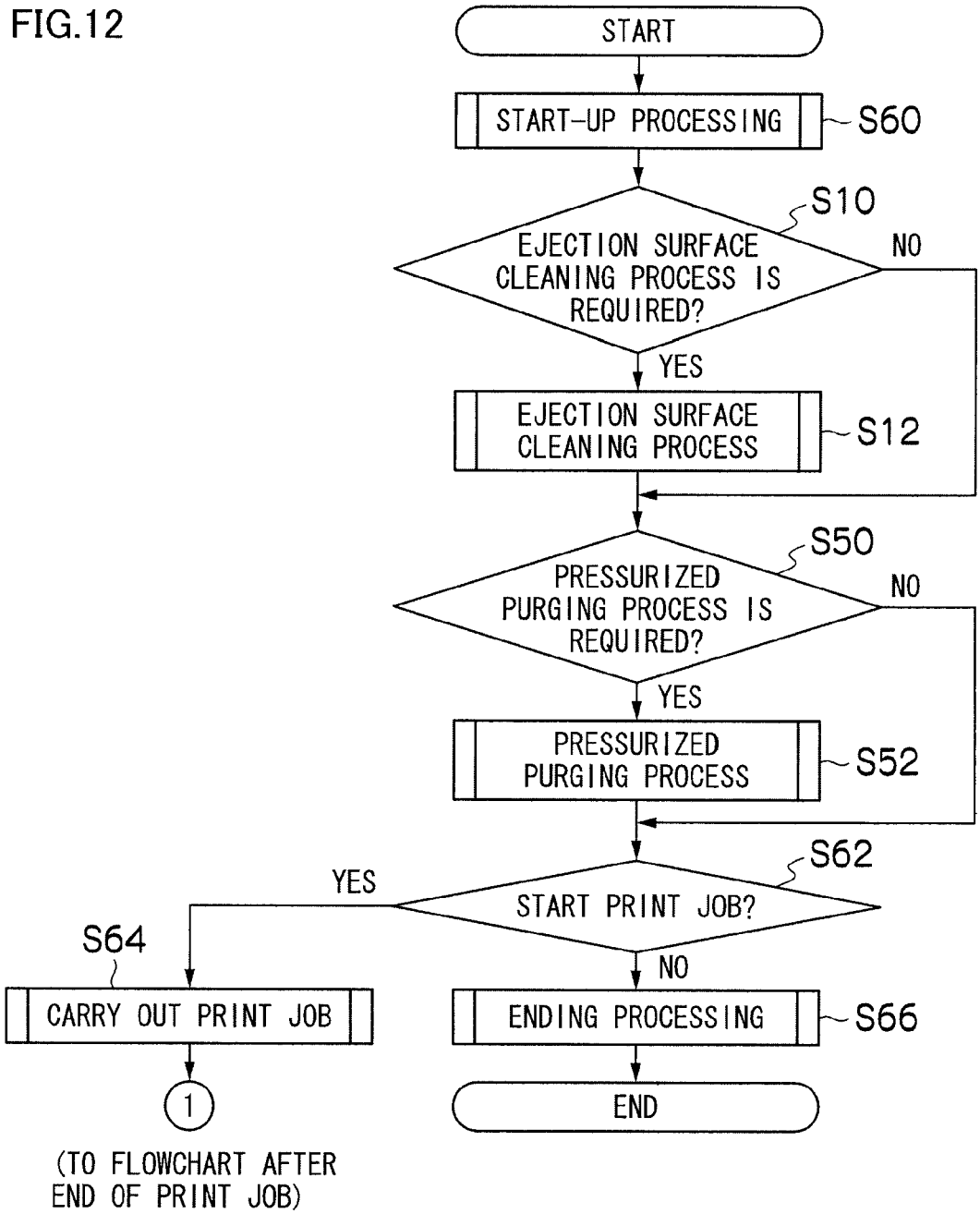
FIG. 12 is a diagram showing a further example of a flowchart upon start-up of a liquid ejection apparatus.

FIG. 12 is a diagram showing a further example of the flowchart when starting up the liquid ejection apparatus. In FIG. 12, processes which are the same as or similar to FIG. 7 to FIG. 11 are labelled with the same reference numerals and description thereof is omitted here.

In the example shown in FIG. 12, similarly to the example shown in FIG. 9 and FIG. 10, the pressurized purging process in step S52 is carried out after the ejection surface cleaning process in step S12 has been performed.

According to the example shown in FIG. 12, even if cleaning liquid infiltrates inside the nozzles of the head 12 when an ejection surface cleaning process is carried out during start-up of the apparatus, this cleaning liquid is discharged to the exterior by a pressurized purging process and therefore it is possible to ensure stable print quality immediately after the start-up of the apparatus.

Figure 13:
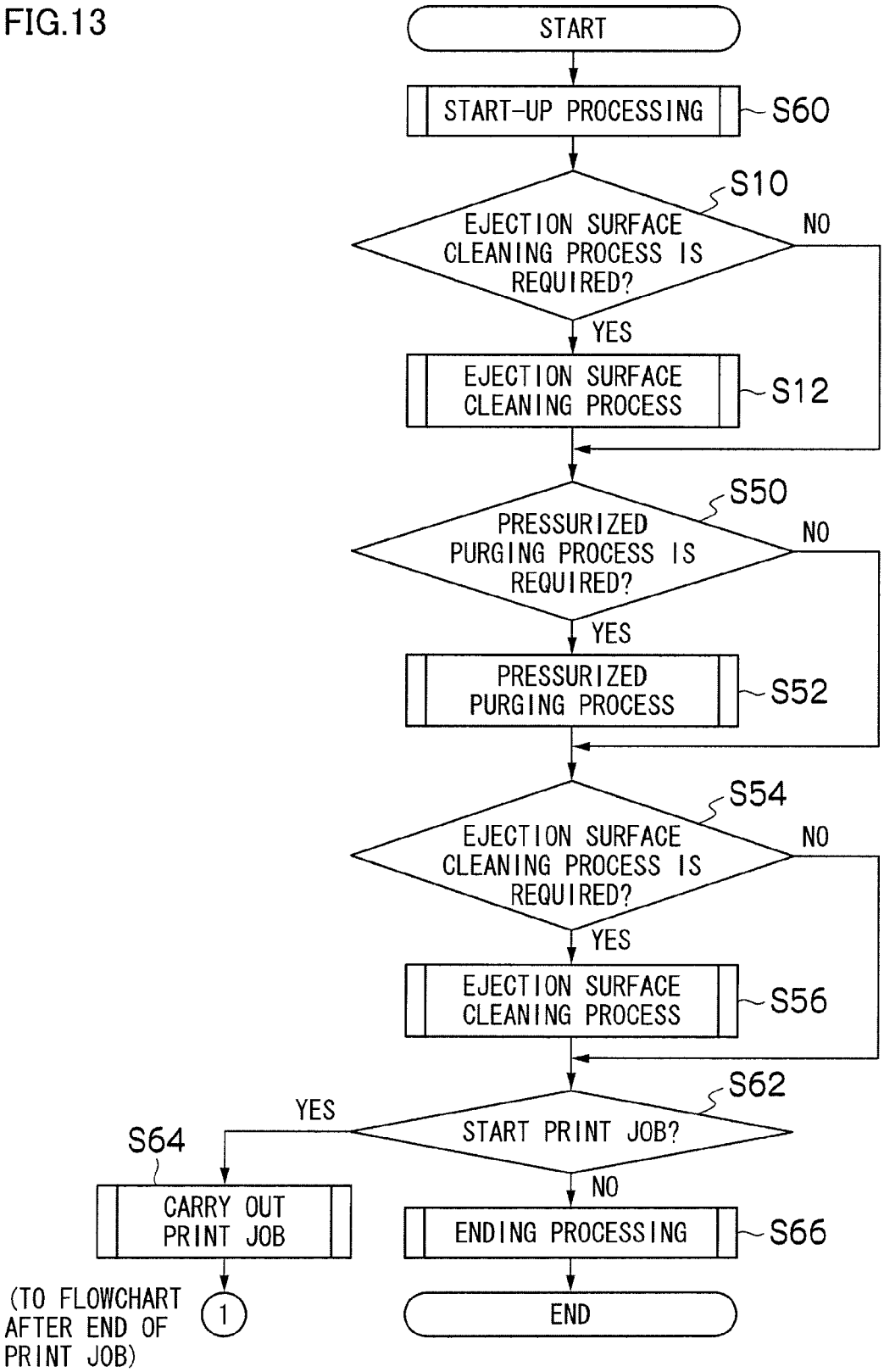
FIG. 13 is a diagram showing yet a further example of a flowchart upon start-up of a liquid ejection apparatus.

FIG. 13 is a diagram showing yet a further example of the flowchart when starting up the liquid ejection apparatus. In FIG. 13, processes which are the same as or similar to FIG. 7 to FIG. 12 are labelled with the same reference numerals and description thereof is omitted here.

In the example shown in FIG. 13, similarly to the example shown in FIG. 10, not only is a pressurized purging process carried out in step S52 after performing the ejection surface cleaning process (first ejection surface cleaning process) in step S12, but furthermore, an ejection surface cleaning process (second ejection surface cleaning process) in step S56 is carried out subsequently.

According to the example shown in FIG. 10, even if ink has adhered to the ejection surface 12*a* due to the pressurized purging process when the apparatus is started up, the ink adhering to the ejection surface 12*a* is removed by the second ejection surface cleaning process which is carried out subsequently, and therefore it is possible to ensure even more stable print quality immediately after the start-up of the apparatus.

Application

Figure 14:
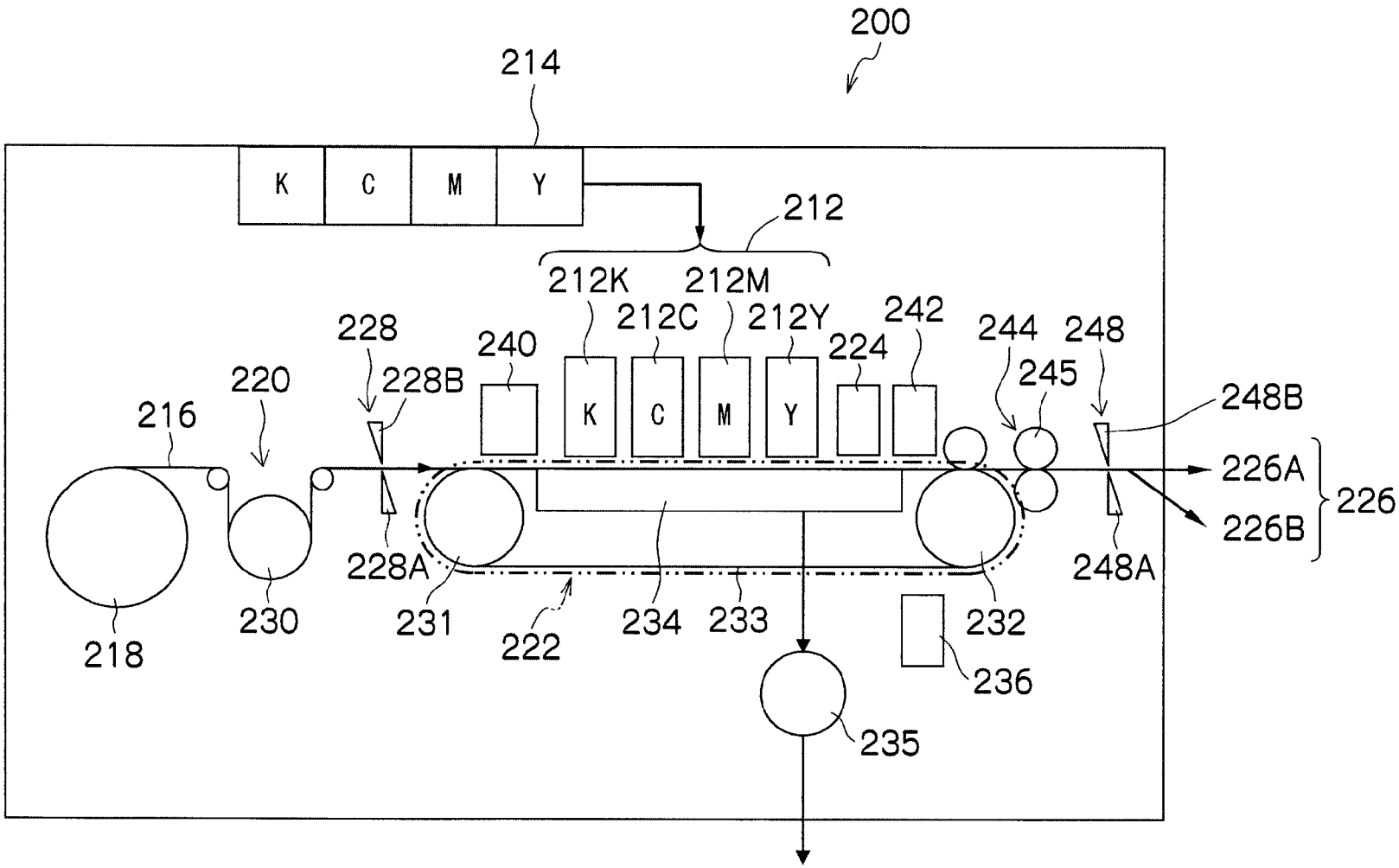
FIG. 14 is a general schematic drawing showing an example of the overall composition of an inkjet recording apparatus.

FIG. 14 is a diagram of the general composition of an inkjet recording apparatus as an example of a liquid ejection apparatus comprising an ejection surface cleaning device according to an embodiment of the present invention. As shown in FIG. 14, the inkjet recording apparatus 200 includes: a print unit 212 having a plurality of inkjet heads (hereafter, called "heads") 212K, 212C, 212M, and 212Y provided for colored inks of black (K), cyan (C), magenta (M), and yellow (Y), respectively; an ink storing and loading unit 214 for storing the inks of K, C, M and Y to be supplied to the heads 212K, 212C, 212M, and 212Y; a paper supply unit 218 for supplying recording paper 216, which is a recording medium; a decurling unit 220 removing curl in the recording paper 216; a suction belt conveyance unit 222 disposed facing the ink ejection faces (nozzle forming surfaces) of the heads 212K, 212C, 212M, and 212Y, for conveying the recording paper 216 while keeping the recording paper 216 flat; and a paper output unit 226 for outputting image-printed recording paper (printed matter) to the exterior.

Furthermore, the inkjet recording apparatus 200 shown in FIG. 14 comprises a cleaning apparatus (not shown in FIG. 14 and indicated by reference numeral 310 in FIG. 18) which carries out maintenance of the ink ejection surfaces of the heads 212K, 212C, 212M and 212Y.

The ink storing and loading unit 214 has ink supply tanks 260 (not shown in FIG. 14, and shown in FIG. 18) for storing the inks of K, C, M and Y to be supplied to the heads 212K, 212C, 212M, and 212Y, and the ink supply tanks are respectively connected to the heads 212K, 212C, 212M, and 212Y by means of prescribed ink flow channels.

The ink storing and loading unit 214 has a warning device (for example, a display device or an alarm sound generator) for warning when the remaining amount of any ink is low, and has a mechanism for preventing loading errors among the colors. The details of the ink supply system including the ink storing and loading unit 214 shown in FIG. 14 are described later.

In FIG. 14, a magazine for rolled paper (continuous paper) is shown as an example of the paper supply unit 218; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper can be used, it is desirable that an information recording medium such as a bar code and a wireless tag containing information about the type of paper is attached to the magazine, and by reading the information contained in the information recording medium with a predetermined reading device, the type of recording medium to be used (type of medium) is automatically determined, and ink droplet ejection is controlled so that the ink droplets are ejected in an appropriate manner in accordance with the type of medium.

The recording paper 216 delivered from the paper supply unit 218 retains curl due to having been loaded in the magazine. In order to remove the curl, heat is applied to the recording paper 216 in the decurling unit 220 by a heating drum 230 in the direction opposite from the curl direction in the magazine. The heating temperature at this time is desirably controlled so that the recording paper 216 has a curl in which the surface on which the print is to be made is slightly round outward.

In the case of the configuration in which roll paper is used, a cutter (first cutter) 228 is provided as shown in FIG. 14, and the continuous paper is cut into a desired size by the cutter 228. The cutter 228 has a stationary blade 228A, whose length is not less than the width of the conveyor pathway of the recording paper 216, and a round blade 228B, which moves along the stationary blade 228A. The stationary blade 228A is disposed on the reverse side of the printed surface of the recording paper 216, and the round blade 228B is disposed on the printed surface side across the conveyor pathway. When cut papers are used, the cutter 228 is not required.

The decurled and cut recording paper 216 is delivered to the suction belt conveyance unit 222. The suction belt conveyance unit 222 has a configuration in which an endless belt 233 is set around rollers 231 and 232 so that the portion of the endless belt 233 facing at least the nozzle faces of the print unit 212 forms a horizontal plane (flat plane).

The belt 233 has a width that is greater than the width of the recording paper 216, and a plurality of suction apertures (not shown) are formed on the belt surface. A suction chamber 234 is disposed in a position facing the nozzle faces of the print unit 212 on the interior side of the belt 233, which is set around the rollers 231 and 232, as shown in FIG. 14. The suction chamber 234 provides suction with a fan 235 to generate a negative pressure, and the recording paper 216 is held on the belt 233 by suction.

The belt 233 is driven in the clockwise direction in FIG. 14 by the motive force of a motor 288 (not shown in FIG. 14, and shown in FIG. 19) being transmitted to at least one of the rollers 231 and 232, which the belt 233 is set around, and the recording paper 216 held on the belt 233 is conveyed from left to right in FIG. 14.

Since the ink adheres to the belt 233 when a marginless print job or the like is performed, a belt-cleaning unit 236 is disposed in a predetermined position (a suitable position outside the printing area) on the exterior side of the belt 233. Although the details of the configuration of the belt-cleaning unit 236 are not shown, examples thereof include a configuration of nipping with a brush roller and a water absorbent roller, or an air blow configuration in which clean air is blown, or a combination of these. In the case of the configuration in which the belt 233 is nipped with the cleaning rollers, it is desirable to make the line velocity of the cleaning rollers different from that of the belt 233 to improve the cleaning effect.

The inkjet recording apparatus can have a roller nip conveyance mechanism, in place of the suction belt conveyance unit 222. However, there is a drawback in the roller nip conveyance mechanism that the print tends to be blurred when the printing area is conveyed by the roller nip action because the nip roller makes contact with the printed surface of the paper immediately after printing. Therefore, the suction belt conveyance in which nothing comes into contact with the image surface in the printing area is desirable.

A heating fan 240 is disposed on the upstream side of the print unit 212 in the conveyance pathway formed by the suction belt conveyance unit 222. The heating fan 240 blows heated air onto the recording paper 216 to heat the recording paper 216 immediately before printing so that the ink deposited on the recording paper 216 dries more easily.

Figure 15:
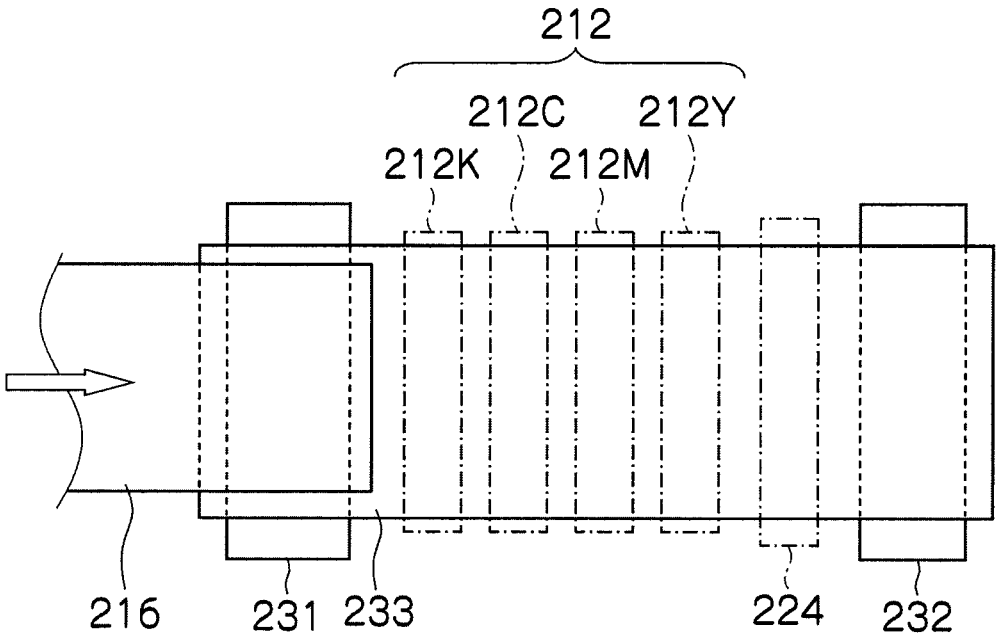
FIG. 15 is a plan diagram showing a principal part of an inkjet recording apparatus.

The heads 212K, 212C, 212M, and 212Y of the print unit 212 are full line heads having a length corresponding to the maximum width of the recording paper 216 used with the inkjet recording apparatus 200, and having a plurality of nozzles for ejecting ink arranged on a nozzle face through a length exceeding at least one edge of the maximum-size recording medium (namely, the full width of the printable range) (see FIG. 15).

The heads 212K, 212C, 212M, and 212Y are arranged in color order (black (K), cyan (C), magenta (M), yellow (Y)) from the upstream side in the feed direction of the recording paper 216, and the heads 212K, 212C, 212M, and 212Y are fixed extending to the conveyance direction of the recording paper 216 (paper conveyance direction).

A color image can be formed on the recording paper 216 by ejecting and depositing inks of different colors from the heads 212K, 212C, 212M, and 212Y, respectively, onto the recording paper 216 while the recording paper 216 is conveyed by the suction belt conveyance unit 222.

By adopting a configuration in which the full line heads 212K, 212C, 212M, and 212Y having nozzle rows covering the full paper width are provided for the respective colors in this way, it is possible to record an image on the full surface of the recording paper 216 by performing just one operation of relatively moving the recording paper 216 and the print unit 212 in the paper conveyance direction (sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged. In an inkjet recording apparatus based on a two-liquid system in which treatment liquid and ink are deposited on the recording paper 216, and the ink coloring material is caused to aggregate or become insoluble on the recording paper 216, thereby separating the ink solvent and the ink coloring material on the recording paper 216, it is possible to provide an inkjet head as a device for depositing the treatment liquid onto the recording paper 216.

The print determination unit 224 has an image sensor for capturing an image of the ink-droplet deposition result of the print unit 212, and functions as a device to check for ejection abnormalities such as clogs of the nozzles in the print unit 212 from the ink-droplet deposition results evaluated by the image sensor.

The print determination unit 224 of the present embodiment is configured with at least a line sensor having rows of photoelectric transducing elements with a width that is greater than the ink-droplet ejection width (image recording width) of the heads 212K, 212C, 212M, and 212Y. This line sensor has a color separation line CCD sensor including a red (R) row of photoreceptor element composed of photoelectric transducing elements (pixels) arranged in a line provided with an R filter, a green (G) row of photoreceptor element with a G filter, and a blue (B) row of photoreceptor element with a B filter. Instead of a line sensor, it is possible to use an area sensor composed of photoelectric transducing elements which are arranged two-dimensionally.

The print determination unit 224 reads a test pattern image printed by the heads 212K, 212C, 212M, and 212Y for the respective colors, and the ejection of each head 212K, 212C, 212M, and 212Y is determined. The ejection determination includes the presence of the ejection, measurement of the dot size, and measurement of the dot deposition position.

A post-drying unit 242 is disposed following the print determination unit 224. The post-drying unit 242 is a device to dry the printed image surface, and includes a heating fan, for example. It is desirable to avoid contact with the printed surface until the printed ink dries, and a device that blows heated air onto the printed surface is desirable.

A heating/pressurizing unit 244 is disposed following the post-drying unit 242. The heating/pressurizing unit 244 is a device to control the glossiness of the image surface, and the image surface is pressed with a pressure roller 245 having a predetermined uneven surface shape while the image surface is heated, and the uneven shape is transferred to the image surface.

When the recording paper 216 is pressed by the heating/pressurizing unit 244, in cases in which printing is performed with dye-based ink on porous paper, blocking the pores of the paper by the application of pressure prevents the ink from coming contact with ozone and other substance that cause dye molecules to break down, and has the effect of increasing the durability of the print.

The printed matter generated in this manner is outputted from the paper output unit 226. The target print (i.e., the result of printing the target image) and the test print are desirably outputted separately. In the inkjet recording apparatus 200, a sorting device (not shown) is provided for switching the outputting pathways in order to sort the printed matter with the target print and the printed matter with the test print, and to send them to paper output units 226A and 226B, respectively. When the target print and the test print are simultaneously formed in parallel on the same large sheet of paper, the test print portion is cut and separated by a cutter (second cutter) 248. The cutter 248 is disposed directly in front of the paper output unit 226, and is used for cutting the test print portion from the target print portion when a test print has been performed in the blank portion of the target print. The structure of the cutter 248 is the same as the first cutter 228 described above, and has a stationary blade 248A and a round blade 248B.

Although not shown in FIG. 14, the paper output unit 226A for the target prints is provided with a sorter for collecting prints according to print orders.

Structure of Head

Next, the structure of the head is described. The heads 212K, 212C, 212M, and 212Y for the respective colored inks have the same structure, and a reference numeral 250 is hereinafter designated to any of the heads.

Figure 16A:
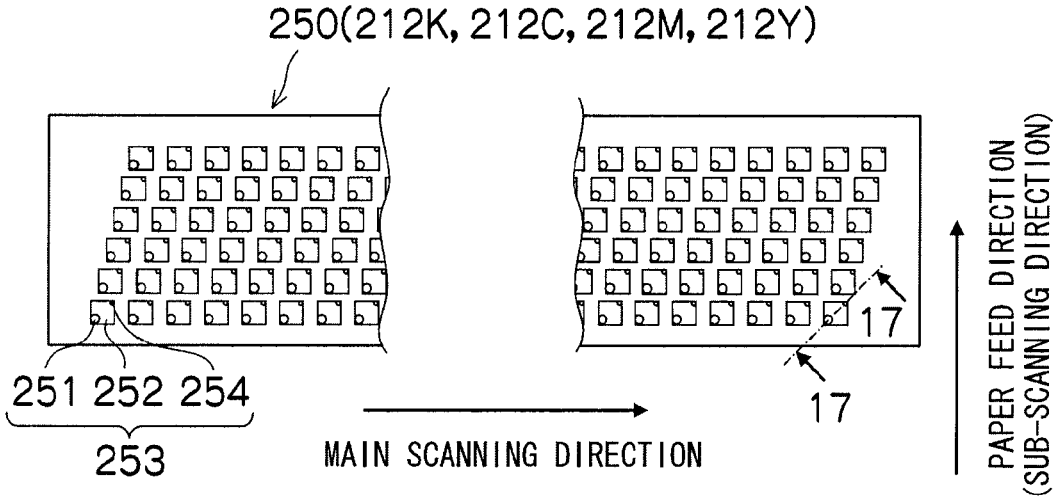
FIGS. 16A to 16C are plan view perspective diagrams showing examples of the composition of a print head.
Figure 16B:
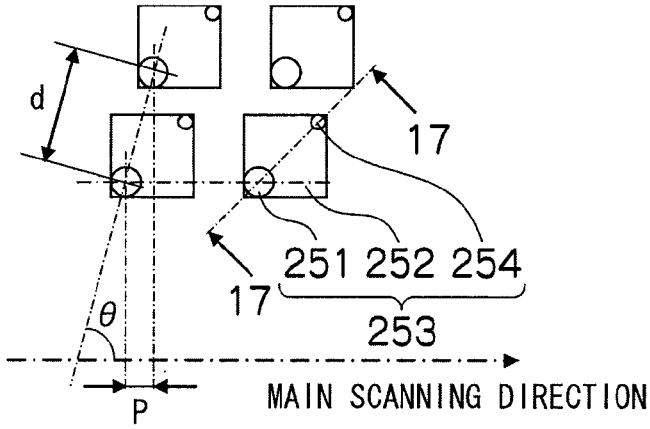
Figure 16C:
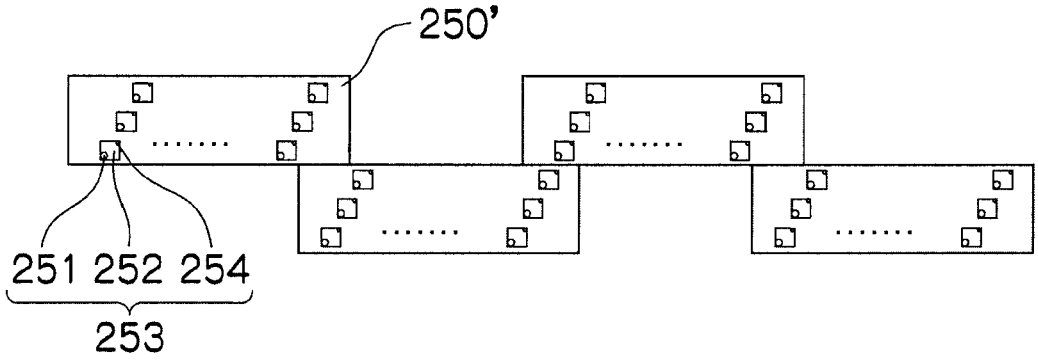
Figure 17:
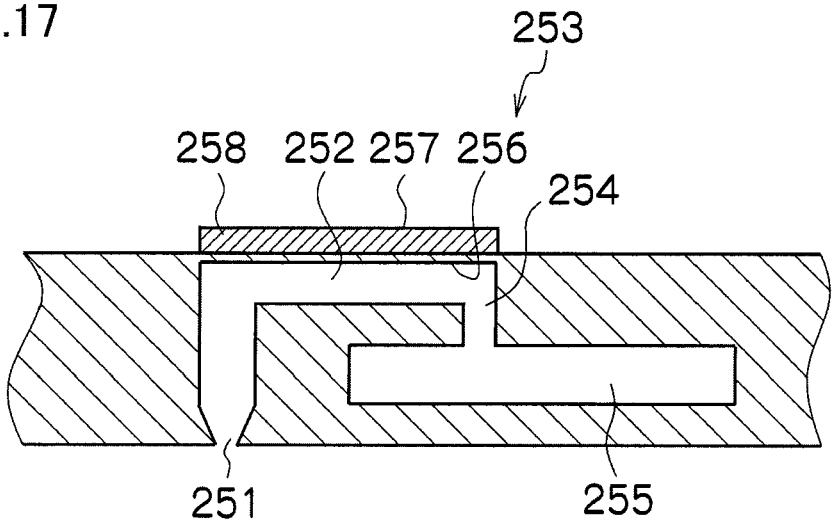
FIG. 17 is a cross-sectional diagram along line 17-17 in FIGS. 16A and 16B showing the composition of an ink chamber unit.

FIG. 16A is a perspective plan view showing an embodiment of the configuration of the head 250, FIG. 16B is an enlarged view of a portion thereof, FIG. 16C is a perspective plan view showing another example of the configuration of the head 250, and FIG. 17 is a cross-sectional view taken along the line 17-17 in FIGS. 16A and 16B, showing an ink chamber unit.

The nozzle pitch in the head 250 should be minimized in order to maximize the density of the dots printed on the surface of the recording paper 216. As shown in FIGS. 16A and 16B, the head 250 according to the present embodiment has a structure in which a plurality of ink chamber units 253, each comprising a nozzle 251 forming an ink droplet ejection hole, a pressure chamber 252 corresponding to the nozzle 251, and the like, are disposed two-dimensionally in the form of a staggered matrix, and hence the effective nozzle interval (the projected nozzle pitch) as projected in the lengthwise direction of the head 250 (the direction perpendicular to the paper conveyance direction) is reduced and high nozzle density is achieved.

The mode of forming one or more nozzle rows through a length corresponding to the entire width of the recording paper 216 in the direction substantially perpendicular to the conveyance direction of the recording paper 216 is not limited to the embodiment described above. For example, instead of the configuration in FIG. 16A, as shown in FIG. 16C, a line head having nozzle rows of a length corresponding to the entire width of the recording paper 216 can be formed by arranging and combining, in a staggered matrix, short head blocks 250' having a plurality of nozzles 251 arrayed in a two-dimensional fashion. Furthermore, although not shown in the drawings, it is also possible to compose a line head by arranging short heads in one row.

The planar shape of the pressure chamber 252 provided for each nozzle 251 is substantially a square, and the nozzle 251 and a supply port 254 are disposed in both corners on a diagonal line of the square. Each pressure chamber 252 is connected to a common channel 255 through the supply port 254. The common channel 255 is connected to an ink supply tank 260 (not shown in FIG. 17, and shown in FIG. 18), which is a base tank that supplies ink, and the ink supplied from the ink supply tank is delivered through the common flow channel 255 in FIG. 17 to the pressure chambers 252.

A piezoelectric element 258 provided with an individual electrode 257 is bonded to a diaphragm 256, which forms the upper face of the pressure chamber 252 and also serves as a common electrode, and the piezoelectric element 258 is deformed when a drive voltage is supplied to the individual electrode (drive electrode) 257, thereby causing the ink to be ejected from the nozzle 251. When ink is ejected, new ink is supplied to the pressure chamber 252 from the common flow passage 255, via the supply port 254.

In the present example, a piezoelectric element 258 is used as an ink ejection force generating device which causes ink to be ejected from a nozzle 251 provided in a head 250, but it is also possible to employ a thermal method in which a heater is provided inside a pressure chamber 252 and ink is ejected by using the pressure of film boiling action caused by the heating action of this heater.

As shown in FIG. 16B, the high-density nozzle head according to the present embodiment is achieved by arranging a plurality of ink chamber units 253 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which the ink chamber units 253 are arranged at a uniform pitch d in line with a direction forming an angle of θ with respect to the main scanning direction, the pitch P of the nozzles projected so as to align in the main scanning direction is $d \times \cos\theta$, and hence the nozzles 251 can be regarded to be equivalent to those arranged linearly at a fixed pitch P along the main scanning direction. Such configuration results in a nozzle structure in which the nozzle row projected in the main scanning direction has a high nozzle density of up to 2400 nozzles per inch.

When implementing the present invention, the arrangement structure of the nozzles is not limited to the embodiment shown in the drawings, and it is also possible to apply various other types of nozzle arrangements, such as an arrangement structure having one nozzle row in the sub-scanning direction.

Furthermore, the scope of application of the present invention is not limited to a printing system based on a line type of head, and it is also possible to adopt a serial system where a short head which is shorter than the breadthways dimension of the recording paper 216 is scanned in the breadthways direction (main scanning direction) of the recording paper 216, thereby performing printing in the breadthways direction, and when one printing action in the breadthways direction has been completed, the recording paper 16 is moved through a prescribed amount in the direction perpendicular to the breadthways direction, printing in the breadthways direction of the recording paper 16 is carried out in the next printing region, and by repeating this sequence, printing is performed over the whole surface of the printing region of the recording paper 216.

Configuration of Ink Supply System

Figure 18:
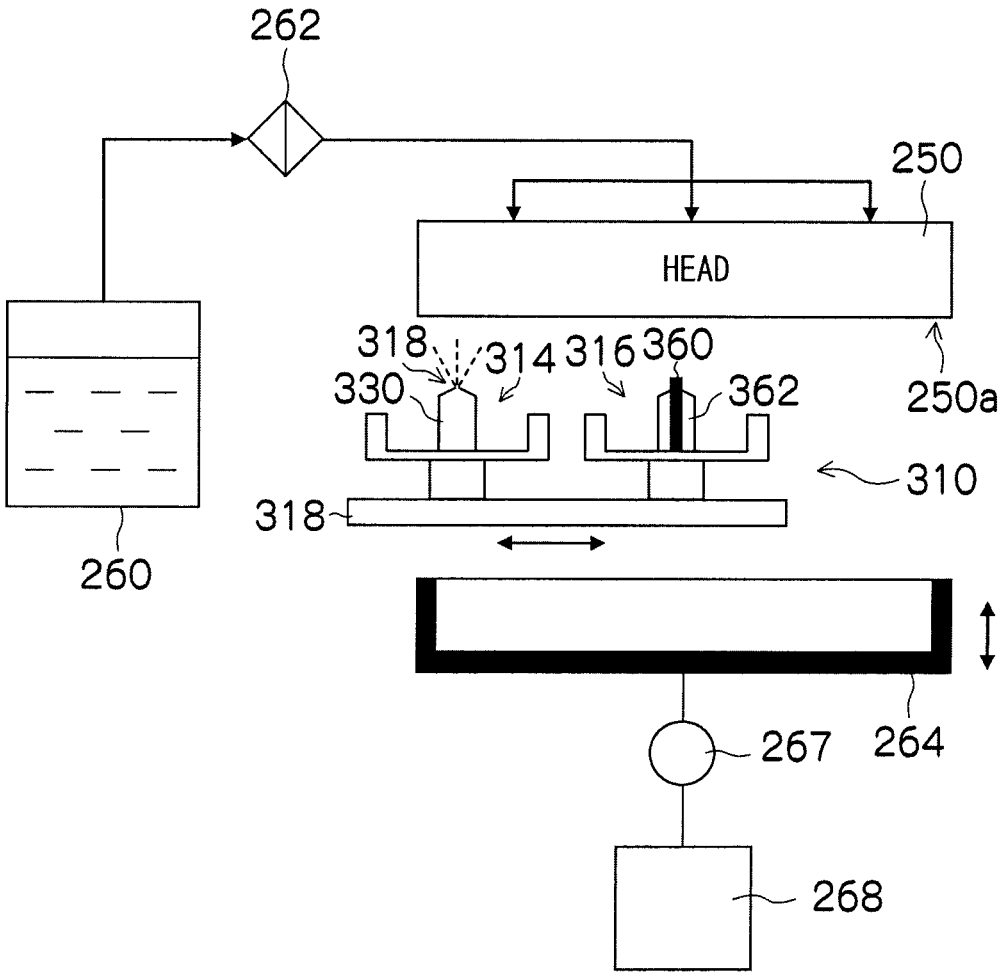
FIG. 18 is a schematic drawing showing the composition of an ink supply system in an inkjet recording apparatus.

FIG. 18 is a schematic drawing showing the configuration of the ink supply system in the inkjet recording apparatus 200. The ink supply tank 260 is a base tank that supplies the ink to the head 250 and is included in the ink storing and loading unit 214 described with reference to FIG. 14. The aspects of the ink supply tank 260 include a refillable type and a cartridge type: when the remaining amount of ink is low, the ink tank 260 of the refillable type is filled with ink through a filling port (not shown) and the ink tank 260 of the cartridge type is replaced with a new one. In order to change the ink type in accordance with the intended application, the cartridge type is suitable, and it is desirable to represent the ink type information with a bar code or the like on the cartridge, and to perform ejection control in accordance with the ink type.

A filter 262 for removing foreign matters and bubbles is disposed between the ink supply tank 260 and the head 250 as shown in FIG. 18. The filter mesh size in the filter 262 is desirably equivalent to or less than the diameter of the nozzle and commonly about 20 μm.

Although not shown in FIG. 18, it is desirable to provide a sub-tank integrally to the print head 250 or nearby the head 250. The sub-tank has a damper function for preventing variation in the internal pressure of the head and a function for improving refilling of the print head.

The inkjet recording apparatus 200 is also provided with a cap 264 as a device to prevent the nozzles 251 from drying out or to prevent an increase in the ink viscosity in the vicinity of the nozzles 251, and a cleaning device 310 as a cleaning device for the nozzle surface.

A maintenance unit including the cap 264 and the cleaning device 310 can be relatively moved with respect to the head 250 by a movement mechanism (not shown), and is moved from a predetermined holding position to a maintenance position below the head 250 as required.

The cap 264 is displaced up and down relatively with respect to the head 250 by an elevator mechanism (not shown). When the power of the inkjet recording apparatus 200 is turned OFF or when in a print standby state, the cap 264 is raised to a predetermined elevated position so as to come into close contact with the head 250, and the nozzle face is thereby covered with the cap 264.

During printing or standby, if the use frequency of a particular nozzle 251 is low, and if a state of not ejecting ink continues for a prescribed time period or more, then the solvent of the ink in the vicinity of the nozzle evaporates and the viscosity of the ink increases. In a situation of this kind, it will become impossible to eject ink from the nozzle 251, even if the piezoelectric element 258 is operated.

Therefore, before a situation of this kind develops (namely, while the ink is within a range of viscosity which allows it to be ejected by operation of the piezoelectric element 258), the piezoelectric element 258 is operated, and a preliminary ejection ("purge", "blank ejection", "liquid ejection" or "dummy ejection") is carried out toward the cap 264 (ink receptacle), in order to expel the degraded ink (namely, the ink in the vicinity of the nozzle which has increased viscosity).

Furthermore, if bubbles enter into the ink inside the head 250 (inside the pressure chamber 252), then even if the piezoelectric element 258 is operated, it will not be possible to eject ink from the nozzle. In a case of this kind, the cap 264 is placed on the head 250, the ink (ink containing bubbles) inside the pressure chamber 252 is removed by suction, by means of a suction pump 267, and the ink removed by suction is then supplied to a recovery tank 268.

This suction operation is also carried out in order to remove degraded ink having increased viscosity (hardened ink), when ink is loaded into the head for the first time, and when the head starts to be used after having been out of use for a long period of time. Since the suction operation is carried out with respect to all of the ink inside the pressure chamber 252, the ink consumption is considerably large. Therefore, desirably, preliminary ejection is carried out when the increase in the viscosity of the ink is still minor.

The inkjet recording apparatus 200 shown in the present embodiment comprises a cleaning apparatus 310 for removing adhering material such as ink which is attached to the ink ejection surface 50*a* of the head 250. This cleaning apparatus 310 has a similar composition to the cleaning apparatus 10 shown in FIG. 2, and comprises a cleaning liquid deposition unit 314 having a spray apparatus 330 which sprays cleaning liquid onto the ink ejection surface 250*a* of the head 250, and an ejection surface wiping unit 316 having a blade 360 which wipes the ink ejection surface 250*a* of the head 250. The cleaning liquid deposition unit 314 and the ejection surface wiping unit 316 are mounted on the same carriage 318 and are composed to be movable reciprocally in a plane parallel to the ink ejection surface 250*a*, in the lengthwise direction of the head 12 (main scanning direction; the horizontal direction in FIG. 1), being driven by a motor which is not illustrated. The composition and operation of the cleaning apparatus 310 are similar to the cleaning apparatus 10 which is described already, and further description thereof is omitted here.

Description of Control System

Figure 19:
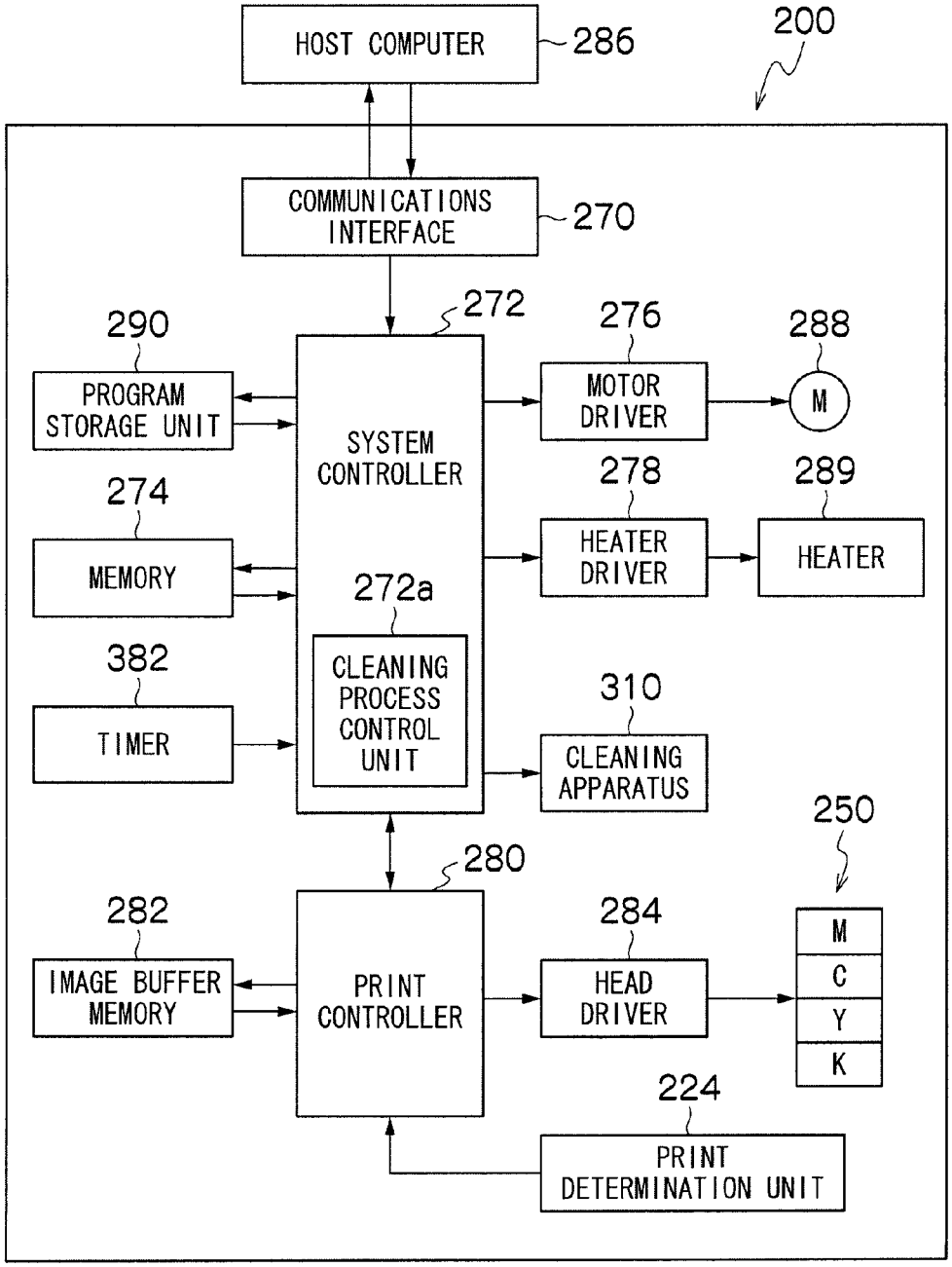
FIG. 19 is a principal block diagram showing the system composition of an inkjet recording apparatus.

FIG. 19 is a principal block diagram showing the system configuration of the inkjet recording apparatus 200. The inkjet recording apparatus 200 includes a communications interface 270, a system controller 272, a memory 274, a motor driver 276, a heater driver 278, a print controller 280, an image buffer memory 282, a head driver 284, and the like.

The communications interface 270 is an interface unit for receiving image data sent from a host computer 286. A serial interface such as USB (Universal Serial Bus), IEEE1394, Ethernet, wireless network, or a parallel interface such as a Centronics interface may be used as the communications interface 270. A buffer memory (not shown) may be mounted in this portion in order to increase the communication speed. The image data sent from the host computer 286 is received by the inkjet recording apparatus 200 through the communications interface 270, and is temporarily stored in the memory 274.

The memory 274 is a storage device for temporarily storing images inputted through the communications interface 270, and data is written and read to and from the memory 274 through the system controller 272. The memory 274 is not limited to a memory composed of semiconductor elements, and a hard disk drive or another magnetic medium may be used.

The system controller 272 is constituted by a central processing unit (CPU) and peripheral circuit thereof, and the like, and it functions as a control device for controlling the whole of the inkjet recording apparatus 200 in accordance with a prescribed program, as well as a calculation device for performing various calculations. More specifically, the system controller 272 controls the various sections, such as the communications interface 270, memory 274, motor driver 276, heater driver 278, and the like, as well as controlling communications with the host computer 286 and writing and reading to and from the image memory 274, and it also generates control signals for controlling the motor 288 of the conveyance system and a heater 289.

Various control programs are stored in the program storage unit 290, and the control programs are read out and executed in accordance with commands from the system controller 272. The program storage unit 290 may use a semiconductor memory, such as a ROM, EEPROM, or a magnetic disk, or the like. An external interface may be provided, and a memory card or PC card may also be used. Naturally, a plurality of these recording media may also be provided. The program storage unit 290 may also be combined with a storage device (not illustrated) for storing operational parameters, and the like.

The program executed by the CPU of the system controller 272 and the various types of data which are required for control procedures are stored in the memory 274. The memory 274 may be a non-writeable storage device, or it may be a rewriteable storage device, such as an EEPROM. The memory 274 is used as a temporary storage region for the image data, and it is also used as a program development region and a calculation work region for the CPU.

The motor driver 276 drives the motor 288 in accordance with commands from the system controller 272. In FIG. 19, the motors (actuators) disposed in the respective sections of the apparatus are represented by the reference numeral 288. For example, the motor 288 shown in FIG. 19 includes the motor of a moving mechanism for moving the cap 264 in FIG. 18 and the motor of a moving mechanism for moving a carriage 318 in FIG. 18, and the like.

The heater driver 278 is a driver which drives heaters 289, including a heater forming a heat source of the heating fan 240 shown in FIG. 14, a heater of the post-drying unit 242, and the like, in accordance with instructions from the system controller 272.

The print controller 280 has a signal processing function for performing various tasks, compensations, and other types of processing for generating print control signals from the image data stored in the memory 274 in accordance with commands from the system controller 272 so as to supply the generated print data (dot data) to the head driver 284. Prescribed signal processing is carried out in the print controller 280, and the ejection amount and the ejection timing of the ink droplets from the respective print heads 250 are controlled via the head driver 284, on the basis of the print data. By this means, desired dot size and dot positions can be achieved.

The print controller 280 is provided with the image buffer memory 282; and image data, parameters, and other data are temporarily stored in the image buffer memory 282 when image data is processed in the print controller 280. Also possible is an aspect in which the print controller 280 and the system controller 272 are integrated to form a single processor.

The head driver 284 is configured by including a drive circuit (shown as reference numeral 100 in FIG. 8) for creating drive signals to be applied to the piezoelectric elements 258 of the head 250 in accordance with the image data provided from the print controller 280, and driving the piezoelectric elements 258 by applying the drive signals (voltage) to the piezoelectric elements 258. The head driver 284 shown in FIG. 19 may also include a feedback control system for maintaining the drive conditions of the head 250 in a constant manner.

The print determination unit 224 is a block that includes the line sensor as described above with reference to FIG. 14, reads the image printed on the recording paper 216, determines the print conditions (presence of the ejection, variation in the dot formation, and the like) by performing desired signal processing, or the like, and provides the determination results of the print conditions to the print controller 280.

According to requirements, the print controller 280 makes various corrections with respect to the head 250 on the basis of information obtained from the print determination unit 224.

The image data to be printed is externally inputted through the communications interface 270, and is stored in the memory 274. In this stage, the RGB image data is stored in the memory 274.

The image data stored in the memory 274 is sent to the print controller 280 through the system controller 272, and is converted to the dot data for each ink color, in the print controller 280. In other words, the print controller 280 performs processing for converting the inputted RGB image data into dot data for the four colors, K, C, M and Y. The dot data generated by the print controller 280 is stored in the image buffer memory 282.

The system controller 272 comprises a cleaning process control unit 272*a* which controls the operations of the respective units of the cleaning apparatus 310, and this control unit controls the operations relating to the cleaning process for the ink ejection surface 250*a* of the head 250 performed by the cleaning apparatus 310, in accordance with instructions from the cleaning process control unit 272*a*.

Furthermore, the system controller 272 acquires information on the elapsed time from a timer 382 for counting the elapsed time since the deposition of cleaning liquid on the ink ejection surface 250*a* by the spray apparatus 330 of the cleaning apparatus 310, and writes this value occasionally to a prescribed region of the memory 274. The timing of the start of wiping of the ink ejection surface 250*a* by the blade 360 is controlled on the basis of this timer value.

In the present application example, an inkjet recording apparatus which forms a color image on a recording medium is described as one example of a liquid ejection apparatus to which the ejection surface cleaning apparatus relating to the present invention can be applied, but the present invention can also be applied broadly to other liquid ejection apparatuses, such as a dispenser.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An ejection surface cleaning apparatus for cleaning a liquid ejection surface of a liquid ejection head ejecting an ejection liquid, comprising:

a cleaning liquid deposition device which deposits a cleaning liquid that dissolves or redisperses the ejection liquid, onto the liquid ejection surface;

a wiping device which wipes the liquid ejection surface onto which the cleaning liquid has been deposited; and a control device which controls a leave time from deposition of the cleaning liquid onto the liquid ejection surface until wiping performed by the wiping device, wherein the control device sets the leave time according to a required leave time at least so as not to exceed a cleaning liquid drying time, the required leave time being a minimum time required to dissolve or redisperse the ejection liquid adhering to the liquid ejection surface with the cleaning liquid and to remove the ejection liquid from the liquid ejection surface by wiping performed by the wiping device, the cleaning liquid drying time being a maximum possible time for which the cleaning liquid deposited on the liquid ejection surface can be left without drying.

2. The ejection surface cleaning apparatus as defined in claim 1, further comprising a temperature and humidity determination device which determines temperature and humidity in a vicinity of the liquid ejection surface, wherein the control device sets the leave time further according to the temperature and the humidity determined by the temperature and humidity determination device.

3. The ejection surface cleaning apparatus as defined in claim 1, wherein when the required leave time is shorter than the cleaning liquid drying time, the control device sets the leave time so as to be equal to the required leave time.

4. The ejection surface cleaning apparatus as defined in claim 1, wherein when the required leave time is longer than the cleaning liquid drying time, the control device divides an ejection surface cleaning process performed by the cleaning liquid deposition device and the wiping device into a plurality of ejection surface cleaning operations, and sets the leave time of the cleaning liquid per operation so as to be equal to or less than the cleaning liquid drying time.

5. The ejection surface cleaning apparatus as defined in claim 4, wherein the control device performs setting such that a product of the leave time and number of implementations of the plurality of ejection surface cleaning operations is equal to the required leave time.

6. The ejection surface cleaning apparatus as defined in claim 5, wherein the control device sets the leave time so as to be equal to the cleaning liquid drying time.

7. The ejection surface cleaning apparatus as defined in claim 1, further comprising a print job time notification device which reports, to the control device, an implementation time of a latest print job carried out by the liquid ejection head, wherein the control device sets the leave time further according to the implementation time of the latest print job reported from the print job time notification device.

8. The ejection surface cleaning apparatus as defined in claim 1, further comprising:

a temperature and humidity determination device which determines temperature and humidity in a vicinity of the liquid ejection surface; and a print job time notification device which reports, to the control device, an implementation time of a latest print job carried out by the liquid ejection head, wherein the control device sets the leave time further according to the temperature and the humidity determined by the temperature and humidity determination device, and the implementation time of the latest print job reported from the print job time notification device.

9. The ejection surface cleaning apparatus as defined in claim 8, wherein the required leave time is determined according to the temperature and the humidity determined by the temperature and humidity determination device and the implementation time of the latest print job reported from the print job time notification device.

10. The ejection surface cleaning apparatus as defined in claim 8, wherein the cleaning liquid drying time is derived from the temperature and the humidity determined by the temperature and humidity determination device.

11. The ejection surface cleaning apparatus as defined in claim 8, further comprising a memory storing a cleaning process data table associating the leave time and number of implementations of ejection surface cleaning operations into which an ejection surface cleaning process performed by the cleaning liquid deposition device and the wiping device is divided, with the temperature and the humidity in the vicinity of the liquid ejection surface and the implementation time of the latest print job carried out by the liquid ejection head, the leave time and the number of implementations of the ejection surface cleaning operations being determined based on the required leave time and the cleaning liquid drying time calculated from the temperature and the humidity in the vicinity of the liquid ejection surface and the implementation time of the latest print job carried out by the liquid ejection head, wherein the control device acquires the leave time and the number of implementations of the ejection surface cleaning operations, from the temperature and the humidity determined by the temperature and humidity determination device and the implementation time of the latest print job reported from the print job time notification device with reference to the cleaning process data table.

12. The ejection surface cleaning apparatus as defined in claim 8, further comprising a memory storing a cleaning process data table associating the required leave time and the cleaning liquid drying time with the temperature and the humidity in the vicinity of the liquid ejection surface and the implementation time of the latest print job carried out by the liquid ejection head, wherein the control device acquires the required leave time and the cleaning liquid drying time from the temperature and the humidity determined by the temperature and humidity determination device and the implementation time of the latest print job reported from the print job time notification device with reference to the cleaning process data table, and calculates the leave time and number of implementations of ejection surface cleaning operations into which an ejection surface cleaning process performed by the cleaning liquid deposition device and the wiping device is divided, from the acquired required leave time and the acquired cleaning liquid drying time.

13. The ejection surface cleaning apparatus as defined in claim 8, further comprising a memory storing a cleaning process data table associating the leave time and number of implementations of ejection surface cleaning operations into which an ejection surface cleaning process performed by the cleaning liquid deposition device and the wiping device is divided, with the temperature and the humidity in the vicinity of the liquid ejection surface and the implementation time of the latest print job carried out by the liquid ejection head, the leave time and the number of implementations of the ejection surface cleaning operations being determined based on the required leave time and the cleaning liquid drying time calculated from the temperature and the humidity in the vicinity of the liquid ejection surface and one implementation time of the latest print job carried out by the liquid ejection head, wherein the control device acquires the leave time and the number of implementations of the ejection surface cleaning operations from the temperature and the humidity determined by the temperature and humidity determination device with reference to the cleaning process data table.

14. A liquid ejection apparatus, comprising:

a liquid ejection head which ejects an ejection liquid; and the ejection surface cleaning apparatus defined in claim 1.

15. An ejection surface cleaning method of cleaning a liquid ejection surface of a liquid ejection head ejecting an ejection liquid, the ejection surface cleaning method comprising the steps of:

depositing a cleaning liquid that dissolves or redisperses the ejection liquid, onto the liquid ejection surface; and wiping the liquid ejection surface onto which the cleaning liquid has been deposited, with a wiping device, wherein a leave time from deposition of the cleaning liquid onto the liquid ejection surface until wiping performed by the wiping device is controlled according to a required leave time at least so as not to exceed a cleaning liquid drying time, the required leave time being a minimum time required to dissolve or redisperse the ejection liquid adhering to the liquid ejection surface with the cleaning liquid and to remove the ejection liquid from the liquid ejection surface by wiping performed by the wiping device, the cleaning liquid drying time being a maximum possible time for which the cleaning liquid deposited on the liquid ejection surface can be left without drying.

* * * * *